US008083225B2

(12) United States Patent
Ohishi et al.

(10) Patent No.: US 8,083,225 B2
(45) Date of Patent: Dec. 27, 2011

(54) SHEET STACKING APPARATUS

(75) Inventors: Taki Ohishi, Tokyo (JP); Masahiro Hagiwara, Tokyo (JP); Masayasu Suzuki, Tokyo (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 0 days.

(21) Appl. No.: 12/869,989

(22) Filed: Aug. 27, 2010

(65) Prior Publication Data

US 2011/0049797 A1 Mar. 3, 2011

(30) Foreign Application Priority Data

Aug. 28, 2009 (JP) ..... 2009-198192

(51) Int. Cl.
*B65H 43/00* (2006.01)

(52) U.S. Cl. ..... 271/176; 271/220

(58) Field of Classification Search ..... 271/176, 271/207, 220
See application file for complete search history.

(56) References Cited

U.S. PATENT DOCUMENTS

| | | | | |
|---|---|---|---|---|
| 2,991,999 | A * | 7/1961 | Doerner | 271/220 |
| 5,467,974 | A * | 11/1995 | Ishiwata et al. | 271/220 |
| 5,836,577 | A | 11/1998 | Arikawa et al. | |
| 6,065,748 | A * | 5/2000 | Hutson | 271/222 |
| 6,588,744 | B2 * | 7/2003 | Ries et al. | 271/220 |
| 2006/0181000 | A1 * | 8/2006 | Nishida et al. | 271/176 |
| 2010/0096801 | A1 * | 4/2010 | Yanagida | 271/220 |

FOREIGN PATENT DOCUMENTS

| | | |
|---|---|---|
| JP | 3336210 | 11/1997 |
| JP | 2005-247524 | 9/2005 |

* cited by examiner

*Primary Examiner* — David H Bollinger
(74) *Attorney, Agent, or Firm* — Seed IP Law Group PLLC

(57) ABSTRACT

A banknote stacking apparatus includes a banknote stacking plate 1 on which banknotes are to be stacked, a first banknote press member 11 fixed to a support shaft 10 so as to be swingably together with the support shaft 10, a second banknote press member 15 which is formed of a synthetic resin sheet having flexibility, whose upstream end portion is fixed to the banknote stacking apparatus and whose downstream end portion is fixed to the first banknote press member 11 and a solenoid 27 for driving the first banknote press member 11 and the banknote stacking apparatus is constituted so that when a banknote is fed into the banknote stacking apparatus and the first banknote press member 11 is driven by the solenoid 27, the first banknote press member 11 is swung and presses a portion of a banknote close to the front end portion thereof and the second banknote press member 15 is swung together with the first banknote press member 11 and deformed so as to form a convex portion 15*c* projecting toward the banknote, whereby a portion of the banknote close to the rear end portion thereof is pressed by the convex portion 15*c* of the second banknote press member 15. According to the thus constituted banknote stacking apparatus, a banknote can be stacked on the banknote stacking plate 1 in the desired manner using a single drive means.

28 Claims, 10 Drawing Sheets

SHEET STACKING APPARATUS

BACKGROUND OF THE INVENTION

The present invention relates to an apparatus for stacking sheets such as banknotes and, in particular, to an apparatus for stacking sheets in a desired manner by means of a simple structure even in the case where a sheet is folded at substantially the central portion thereof, where a sheet is curled at the tip end portion thereof, where a sheet can be easily bent or where a sheet is wrinkled.

DESCRIPTION OF THE PRIOR ART

Japanese Patent No. 3,336,210 discloses a banknote handling machine equipped with a banknote stacking apparatus including a banknote stacking plate on which banknotes are to be stacked, a banknote press member whose rear end portion is supported to be swingable and which is adapted for leading banknotes downwardly, a torsion spring for biasing the front end portion upwardly, a solenoid for pressing the front end portion of the banknote press member toward the banknote stacking plate against the spring force of the torsion spring, a sensor for detecting the rear end portion of each banknote to be stacked, and a control means for actuating the solenoid based on a detection signal output from the sensor when a predetermined time period has passed after the sensor detected the rear end portion of the banknote.

According to the thus constituted banknote stacking apparatus, since the banknote press member is held at a location above the banknote stacking plate when a banknote has been fed to the banknote stacking apparatus, the front end portion of the banknote press member is pressed toward the banknote stacking plate when a predetermined time period has passed after the sensor detected the rear end portion of the banknote, and the front end portion of the banknote is pressed by the banknote press member toward the banknote stacking plate, whereby the banknote is held between the banknote press member and the surface of the banknote stacking plate, even in the case where banknotes tend to be folded or banknotes are wrinkled, the banknotes can be stacked in the desired manner.

However, in the thus constituted banknote stacking apparatus, in the case where banknotes including a banknote folded at substantially a central portion by a wallet or a banknote curled at its tip end portion are to be transported so that the long edge of the banknote coincides with the transporting direction of banknotes and stacked, a portion of the banknote on the rear side of the portion pressed by the banknote press member sometimes projects upwardly. In such a case, it is difficult for the banknote press member to press the so that the banknotes are aligned with the surface of the banknote stacking plate and therefore, the banknotes sometimes cannot be stacked in the desired manner.

Thus, in order to solve these problems, Japanese Patent Application Laid Open No. 2005-247524 proposes a banknote stacking apparatus including a banknote stacking plate on which banknotes are to be stacked, a first banknote press member and a second banknote press member each being constituted so that a rear end portion thereof is swingably supported and a front end portion thereof is biased upwardly by a biasing means, a third banknote press member the rear end portion of which is swingably supported, the front portion of which abuts against the banknote stacking plate under its own weight and the weight of which is so light that even in the case where a banknote apt to be easily folded or a wrinkled banknote is fed into the banknote stacking apparatus or even in the case where a banknote folded at substantially a central portion thereof or a banknote whose front end portion is curled upwardly is fed into the banknote stacking apparatus with the front end portion thereof projecting upwardly, the third banknote press member is assuredly push up by the front end portion of the banknote, a banknote press member drive means for driving the first banknote press member and the second banknote press member against the biasing force of the biasing means and pressing the other end potions of the first banknote press member and the second banknote press member toward the banknote stacking plate, a sensor means for detecting the rear end portion of each banknote to be stacked on the banknote stacking plate, and a control means for actuating the banknote press member drive means based on a detection signal output from the sensor means when a predetermined time period has passed after the sensor means detected the rear end portion of the banknote, the banknote stacking apparatus being constituted so that when a predetermined time period has passed after the sensor means detected the rear end portion of the banknote to be stacked on the banknote stacking plate, the banknote press member drive means is actuated, whereby the other end portion of the first banknote press member presses a portion of the banknote spaced apart from the rear end portion thereof by a distance equal to about one-third (⅓) of the length of the banknote, the other end portion of the second banknote press member presses substantially a central portion of the banknote in the longitudinal direction of the banknote and the third banknote press member presses a portion of the banknote spaced apart from the front end portion thereof by a distance equal to about one-third (⅓) of the length of the banknote.

According to the thus constituted banknote stacking apparatus, even in the case where a banknote apt to be easily folded or a wrinkled banknote is transported so that the long edge thereof coincides with the transporting direction of the banknotes and fed into the banknote stacking apparatus or even in the case where a banknote folded at substantially a central portion thereof or a banknote whose front end portion is curled upwardly is fed into the banknote stacking apparatus with the front end portion thereof projecting upwardly, the banknote is fed onto the surface of the banknote stacking plate while it is guided along the other end portion of the third banknote press member and, the first banknote press member and the second banknote press member are driven so that the other end portion of the first banknote press member presses a portion of the banknote spaced apart from the rear end portion thereof by a distance equal to about one-third (⅓) of the length of the banknote and the other end portion of the second banknote press member presses substantially a central portion of the banknote in the longitudinal direction of the banknote, whereby the banknote is stopped and the third banknote press member presses a portion of the banknote spaced apart from the front end portion thereof by a distance equal to about one-third (⅓) of the length of the banknote. Therefore, even if a banknote is apt to be easily folded, a banknote is wrinkled, a banknote is folded at substantially a central portion or a banknote is curled at the front end portion thereof, it is possible to stack banknotes on the banknote stacking plate in the desired manner. However, since this banknote stacking apparatus is provided with the first banknote press member the front end portion of which presses a banknote to be stacked on the banknote stacking plate at a portion spaced apart from the rear end portion thereof by a distance equal to about one-third (⅓) of the length of the banknote when it is driven by the banknote press member driving means and the second banknote press member the other end portion of which presses the banknote to be stacked on the banknote stacking plate at substantially a central portion thereof when it is driven by the banknote press member driving means, the structure of the banknote stacking apparatus is inevitably complicated and manufacturing cost inevitably becomes high.

Further, in this banknote stacking apparatus, the front end portion of the third banknote press member abuts against the banknote stacking plate under its own weight and is pushed up by the front end portion of a banknote, thereby guiding the banknote on the banknote stacking plate. Therefore, in the case where very thin banknotes apt to be easily folded are to be stacked on the banknote stacking plate, the third banknote press member cannot be pushed up by the front end portion of the banknote, so that it is sometimes impossible to stack banknotes on the banknote stacking plate in the desired manner.

There has not been proposed a sheet stacking apparatus for stacking sheets other than banknotes, which can stack sheets in a desired manner, in the case where the sheet is folded at substantially a central portion, the sheet is curled upwardly at the front end portion thereof, the sheet is apt to be easily folded or the sheet is wrinkled.

SUMMARY OF THE INVENTION

It is therefore an object of the present invention to provide an apparatus for stacking sheets in a desired manner by means of a simple structure even in the case where a sheet is folded at substantially a central portion thereof, where a sheet is curled at the front end portion thereof, where a sheet can be easily folded or where a sheet is wrinkled.

The above and other objects of the present invention can be accomplished by a sheet stacking apparatus comprising a sheet stacking plate on the surface of which sheets are to be stacked, a first sheet press member whose upstream end portion with respect to a transporting direction of the sheets is firmly fixed to a support shaft so as to be swingable as the support shaft is rotated, a biasing means for biasing the first sheet press member so as to come off from the sheet stacking plate and holding the first sheet press member at a waiting position thereof, a single sheet press member driving means for driving the first sheet press member against a biasing force of the biasing means and pressing the downstream end portion of the first sheet press member toward the sheet stacking plate, at least one second sheet press member whose upstream end portion is mounted on a body of the sheet stacking apparatus and whose downstream end portion is mounted on the first sheet press member, a sensor means for detecting the rear end portion of a sheet to be stacked on the sheet stacking plate, and a control means for actuating the single sheet press member driving means based on a sheet detection signal output from the sensor means when a predetermined time period has passed after the sensor means detected the sheet, the at least one second sheet press member being made of a flexible material, the sheet stacking apparatus being constituted so that the upstream end portion of the at least one second sheet press member is mounted on the body of the sheet stacking apparatus and the downstream end portion of the at least one second sheet press member is mounted on the first sheet press member in such a manner that when the single sheet press member driving means drives the first sheet press member to press the downstream end portion of the first sheet press member against the biasing force of the biasing means toward the sheet stacking plate, the distance between the upstream end portion of the at least one second sheet press member and the downstream end portion thereof is shortened.

According to the present invention, the at least one second sheet press member is made of a flexible material and the upstream end portion of the at least one second sheet press member is connected with the body of the sheet stacking apparatus and the downstream end portion of the at least one second sheet press member is connected with the first sheet press member in such a manner that when the single sheet press member driving means drives the first sheet press member and presses the downstream end portion of the first sheet press member against the biasing force of the biasing means toward the sheet stacking plate, the distance between the upstream end portion of the at least one second sheet press member and the downstream end portion thereof is shorted, so that when the single sheet press member driving means drives the first sheet press member to press the downstream end portion of the first sheet press member against the biasing force of the biasing means in order to stack sheets on the sheet stacking plate, the at least one second sheet press member is deformed convexly toward the sheet stacking plate, whereby a portion in the vicinity of the leading end portion (downstream end portion) of a sheet fed onto the sheet stacking plate is pressed by the first sheet press member toward the sheet stacking plate and a portion on the rear side of the leading end portion (on the upstream side of the downstream end portion) of the sheet fed onto the sheet stacking plate is pressed by a convex portion formed by the deformation of the at least one second sheet press member toward the sheet stacking plate. Therefore, even in the case where the sheet is folded at substantially a central portion thereof, where the sheet is curled upwardly at the leading end portion thereof, where the sheet is apt to be very easily folded, or where the sheet is wrinkled, it is possible to stack sheets in the desired manner only by driving the single sheet press member driving means.

In a preferred aspect of the present invention, the upstream end portion of the at least one second sheet press member is mounted on a portion of the body of the sheet stacking apparatus on the upstream side of the support shaft.

According to this preferred aspect of the present invention, the upstream end portion of the at least one second sheet press member is mounted on the portion of the body of the sheet stacking apparatus on the upstream side of the support shaft, so that when the single sheet press member driving means drives the first sheet press member so as to press the downstream end portion of the first sheet press member toward the sheet stacking plate against the biasing force of the biasing means, the distance between the upstream end portion of the at least one second sheet press member and the downstream end portion thereof is consequently shorted and, therefore, even in the case where the sheet is folded at substantially a central portion thereof, where the sheet is curled upwardly at the leading end portion thereof, where the sheet is apt to be very easily folded, or where the sheet is wrinkled, it is possible to stack sheets in the desired manner only by driving the single sheet press member driving means.

In another preferred aspect of the present invention, the upstream end portion of the at least one second sheet press member is mounted on the body of the sheet stacking apparatus at a position on the side toward the sheet stacking plate from a plane including the support shaft and parallel with a plane including a main portion of the first sheet press member located at the waiting position thereof.

According to this preferred aspect of the present invention, since the upstream end portion of the at least one second sheet press member is mounted on the body of the sheet stacking apparatus at a position on the side toward the sheet stacking plate from a plane including the support shaft and parallel with a plane including a main portion of the first sheet press member located at the waiting position thereof, so that when the single sheet press member driving means drives the first sheet press member so as to press the downstream end portion of the first sheet press member toward the sheet stacking plate against the biasing force of the biasing means, the distance between the upstream end portion of the at least one second sheet press member and the downstream end portion thereof is consequently shortened and therefore, even in the case where the sheet is folded at substantially a central portion thereof, where the sheet is curled upwardly at the leading end portion thereof, where the sheet is apt to be very easily folded, or where the sheet is wrinkled, it is possible to stack sheets in the desired manner only by driving the single sheet press member driving means.

In a further preferred aspect of the present invention, the upstream end portion of the at least one second sheet press member is mounted on the body of the sheet stacking apparatus at a position on the side toward the sheet stacking plate from a plane including a main portion of the first sheet press member located at the waiting position thereof and the support shaft.

According to this preferred aspect of the present invention, since the upstream end portion of the at least one second sheet press member is mounted on the body of the sheet stacking apparatus at a position on the side toward the sheet stacking plate from a plane including the a main portion of the first sheet press member located at the waiting position thereof and the support shaft, so that when the single sheet press member driving means drives the first sheet press member so as to press the downstream end portion of the first sheet press member toward the sheet stacking plate against the biasing force of the biasing means, the distance between the upstream end portion of the at least one second sheet press member and the downstream end portion thereof is consequently shortened and, therefore, even in the case where the sheet is folded at substantially a central portion thereof, where the sheet is curled upwardly at the leading end portion thereof, where the sheet is apt to be very easily folded, or where the sheet is wrinkled, it is possible to stack sheets in the desired manner only by driving the single sheet press member driving means.

In a further preferred aspect of the present invention, a surface of the at least one second sheet press member in the vicinity of the upstream end portion thereof is firmly fixed to the body of the sheet stacking apparatus, whereby the upstream end portion of the at least one second sheet press member is mounted on the body of the sheet stacking apparatus.

In another preferred aspect of the present invention, the upstream end portion of the at least one second sheet press member is firmly fixed to a linear region of the body of the sheet stacking apparatus, whereby the upstream end portion of the at least one second sheet press member is mounted on the body of the sheet stacking apparatus.

In a further preferred aspect of the present invention, the upstream end portion of the at least one second sheet press member is firmly fixed to an inner surface of a slit formed in the body of the sheet stacking apparatus, whereby the upstream end portion of the at least one second sheet press member is mounted on the body of the sheet stacking apparatus.

In a further preferred aspect of the present invention, the upstream end portion of the at least one second sheet press member is mounted on the body of the sheet stacking apparatus so as to be swingable about a support shaft provided in the body of the sheet stacking apparatus.

In a further preferred aspect of the present invention, a surface of the at least one second sheet press member in the vicinity of the downstream end portion thereof is firmly fixed to the first sheet press member, whereby the at least one second sheet press member is mounted on the body of the sheet stacking apparatus.

In another preferred aspect of the present invention, the downstream end portion of the at least one second sheet press member is firmly fixed to a linear region of the body of the sheet stacking apparatus.

In another preferred aspect of the present invention, the downstream end portion of the at least one second sheet press member is mounted on the first sheet press member so as to be swingable about a support shaft provided in the first sheet press member.

In a further preferred aspect of the present invention, the first sheet press member has a fork-like shape and has a plurality of teeth formed by furcating a downstream portion of the first sheet press member, and the downstream end portion of the at least one second sheet press member is mounted on at least one of the plurality of teeth of the first sheet press member.

In a further preferred aspect of the present invention, the sheet stacking apparatus further comprises a plurality of the second sheet press members and the downstream portion of each of the plurality of the second sheet press members is mounted on one of the plurality of teeth of the first sheet press member.

In a further preferred aspect of the present invention, the upstream portion of at least one of the plurality of second sheet press members is mounted on the body of the sheet stacking apparatus in a different manner from a manner of mounting the other upstream portions of the plurality of second sheet press members on the body of the sheet stacking apparatus.

In a further preferred aspect of the present invention, the downstream portion of at least one of the plurality of second sheet press members is mounted on the plurality of teeth of the first sheet press member in a different manner from a manner of mounting the other downstream portions of the plurality of second sheet press members on the plurality of teeth of the first sheet press member.

In a further preferred aspect of the present invention, the second sheet press member is made of a synthetic resin sheet having flexibility.

In another preferred aspect of the present invention, the second sheet press member is made of a metal sheet having flexibility.

In another preferred aspect of the present invention, the sheet stacking apparatus further comprises a vane wheel for scraping off rear end portions of sheets toward the upper surface of the sheet stacking plate.

The above and other objects and features of the present invention will become apparent from the following description made with reference to the accompanying drawings.

DESCRIPTION OF THE PREFERRED EMBODIMENTS

Figure 1:
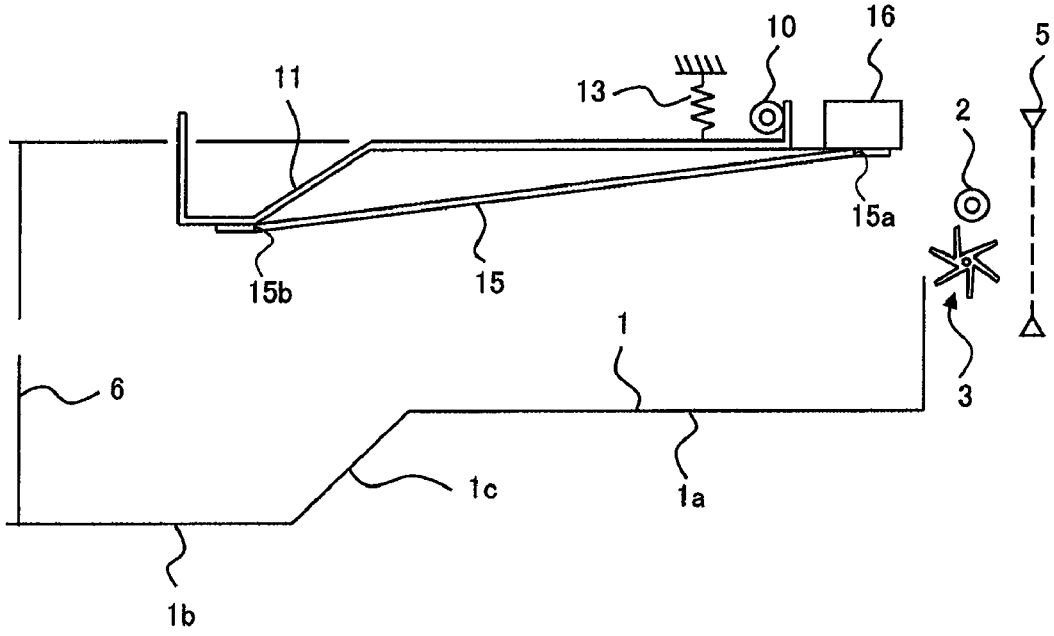
FIG. 1 is a schematic side view of a banknote stacking apparatus which is a preferred embodiment of the present invention.

FIG. 1 is a schematic side view of a banknote stacking apparatus which is a preferred embodiment of the present invention.

A banknote stacking apparatus according to this embodiment constitutes a part of a banknote receiving and dispensing machine and is constituted so as to stack those banknotes among banknotes deposited into the banknote receiving and dispensing machine that are discriminated as acceptable banknotes by a banknote discriminating section. Bills stacked by the banknote stacking apparatus are deposited in the banknote receiving and dispensing machine once and for all or returned to an operator or a customer in accordance with instructions of the operator or the customer.

The banknote stacking apparatus according to this preferred embodiment is constituted so as to stack substantially horizontally-oriented banknotes vertically and, as shown in FIG. 1, the banknote stacking apparatus according to this preferred embodiment includes a banknote stacking plate 1 for stacking banknotes on the upper surface thereof, a pair of rollers 2 and a vane wheel 3 disposed below the pair of rollers 2 and adapted for scraping off rear end portions of banknotes toward the upper surface of the banknote stacking plate, namely, downwardly.

As shown in FIG. 1, there is provided a sensor 5 adapted for detecting rear end portions of banknotes and disposed upstream of the vane wheel 3 with respect to a banknote transporting direction. On the other hand, a shutter 6 is provided at an outlet portion disposed at the most downstream end portion of the banknote stacking apparatus with respect to the banknote transporting direction.

As shown in FIG. 1, the banknote stacking plate 1 includes a first horizontal surface portion 1*a* extending from a portion in the vicinity of the vane wheel 3 in substantially a horizontal direction, an inclined surface portion 1*c* extending from the downstream end portion of the first horizontal surface portion 1*a* obliquely downward and a second horizontal surface portion 1*b* extending from the downstream end portion of the inclined surface portion 1*c* in substantially a horizontal direction.

As shown in FIG. 1, the banknote stacking apparatus according to this preferred embodiment further includes a first banknote press member 11 whose upstream end portion is firmly fixed to a support shaft 10 so as to be swingable as the support shaft 10 is rotated and which can press banknotes fed onto the banknote stacking plate 1. The first banknote press member 11 includes a main portion parallel with the first horizontal surface portion 1*a* of the banknote stacking plate 1 when it is positioned at the waiting position thereof, an inclined portion parallel with the inclined surface portion 1*c* of the banknote stacking plate 1 when it is positioned at the waiting position thereof and a mounting portion mounted on the support shaft 10. The first banknote press member 11 is biased by a tension spring 13 in the clockwise direction about the support shaft 10 so that the main portion of the first banknote press member 11 is kept substantially horizontal at the waiting position thereof shown in FIG. 1.

The banknote stacking apparatus according to this preferred embodiment further includes a second banknote press member 15 whose surface in the vicinity of the downstream end portion thereof is firmly fixed to the first banknote press member 11 and whose surface in the vicinity of the upstream end portion thereof is firmly fixed to a mounting member 16 at a position upstream of the support shaft 10 and on the side toward the banknote stacking plate 1 from the support shaft 10. The second banknote press member 15 is formed of a synthetic resin sheet having flexibility such as a polyethylene terephthalate sheet.

Figure 2:
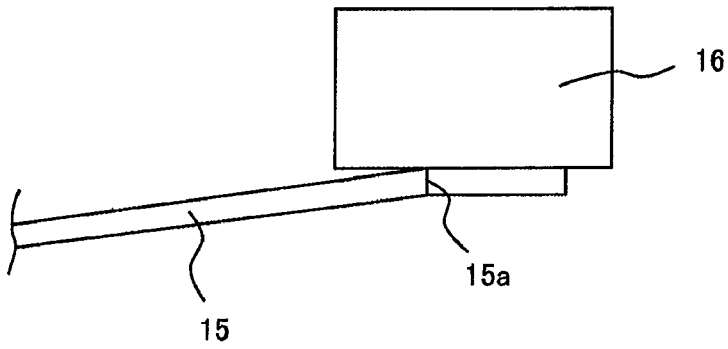
FIG. 2 is a schematic enlarged side view showing details of a portion in the vicinity of an upstream portion of a second banknote press member.

FIG. 2 is a schematic enlarged side view showing details of a portion of the second banknote press member 15 in the vicinity of the upstream end portion thereof. As shown in FIG. 2, the second banknote press member 15 is formed with a crease 15*a* in contact with a portion where the second banknote press member 15 is firmly fixed to the mounting member 16 and the second banknote press member 15 is constituted so as to be swingable about the crease 15*a*. Although not shown in FIG. 2, as described later, the downstream end portion of the second banknote press member 15 is firmly fixed to the first banknote press member 11 and is formed with a crease 15*b* in contact with a portion where the second banknote press member 15 is firmly fixed to the first banknote press member 11 so that the second banknote press member 15 is swingable about the crease 15*b*.

Figure 3:
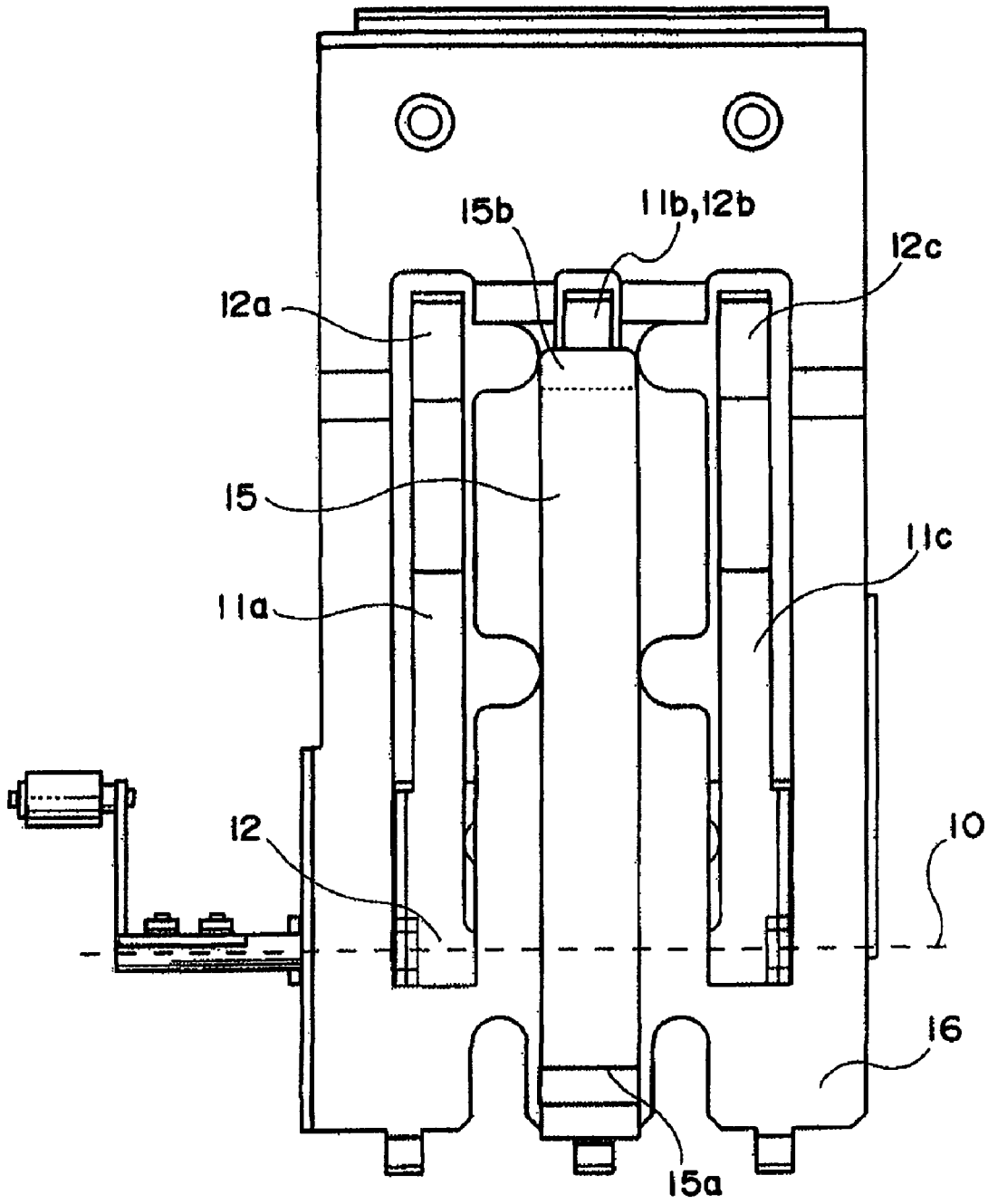
FIG. 3 is a schematic plan view showing the arrangement of a first banknote press member and a second banknote press member of a banknote stacking apparatus.

FIG. 3 is a schematic plan view showing the arrangement of the first banknote press member 11 and the second banknote press member 15.

As shown in FIG. 3, the first banknote press member 11 includes a base end portion 12 firmly fixed to the support shaft 10 and a substantially a fork-shaped plate member having three teeth 11*a*, 11*b* and 11*c* extending toward a downstream side with respect to the banknote transporting direction and parallel with each other and the downstream end portion of each of the teeth 11*a*, 11*b* and 11*c* of the first banknote press member 11 constitutes one of press surfaces 12*a*, 12*b* and 12*c* for pressing banknotes fed to above the banknote stacking plate 1 toward the inclined surface portion 1*c* of the banknote stacking plate 1.

As shown in FIGS. 1 to 3, the surface of the second banknote press member 15 in the vicinity of the upstream end portion thereof is firmly fixed to the mounting member 16 at a position upstream of the support shaft 10 and on the side toward the banknote stacking plate 1 from the support shaft 10. On the other hand, the surface of the second banknote press member 15 in the vicinity of the downstream end portion thereof is firmly fixed to the press surface 12*b* of the tooth 11*b* positioned at a central position among the three teeth 11*a*, 11*b* and 11*c* of the first banknote stacking plate 11.

As shown in FIGS. 1 and 3, the second banknote press member 15 is formed with a crease 15*b* in contact with a portion where the second banknote press member 15 is firmly fixed to the first banknote press member 11 and the second banknote press member 15 is constituted so as to be swingable about the crease 15*b*.

Figure 4:
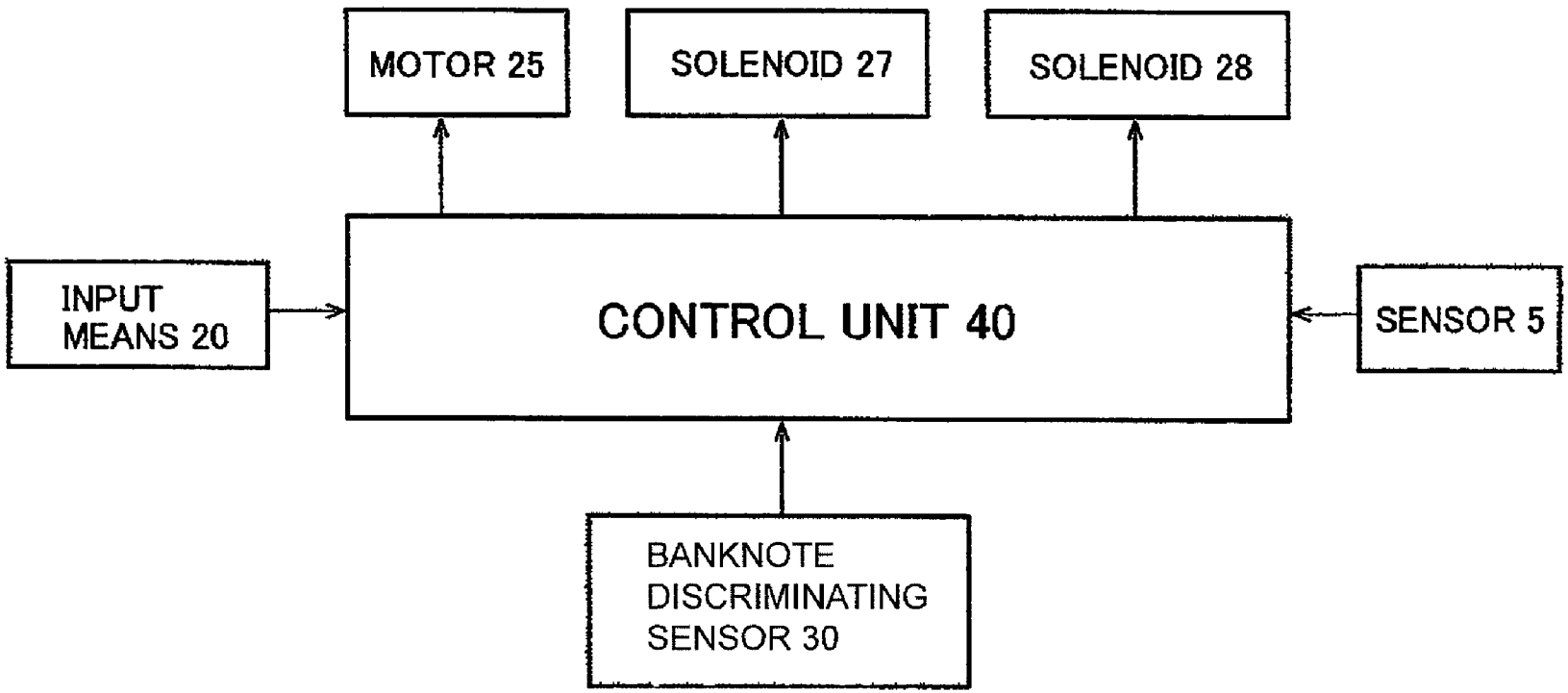
FIG. 4 is a block diagram of an input system, a driving system, a detection system and a control system of a banknote stacking apparatus.

FIG. 4 is a block diagram of an input system, a driving system, a detection system and a control system of the banknote stacking apparatus according to this preferred embodiment.

As shown in FIG. 4, an input system of the banknote stacking apparatus according to this preferred embodiment includes an input means 20 which is operated by the operator or the customer and through which instruction signals can be input.

As shown in FIG. 4, a driving system of the banknote stacking apparatus according to this preferred embodiment includes a motor 25 for rotating the vane wheel 3, a solenoid 27 for driving the first banknote press member 11 and a solenoid 28 for opening and closing the shutter 6.

Further, as shown in FIG. 4, a detection system of the banknote stacking apparatus according to this preferred embodiment includes a banknote discriminating sensor 30 provided in a banknote transporting passage and adapted for detecting an optical pattern of a banknote and the like and outputting a banknote detection signal and the sensor 5 provided upstream of the vane wheel 3 and adapted for detecting rear end potions of banknotes fed to the banknote stacking plate 1.

As shown in FIG. 4, a control system of the banknote stacking apparatus according to this preferred embodiment includes a control unit 40 for discriminating, based on a detection signal input from the banknote discriminating sensor 30, whether the banknote detected by the banknote discriminating sensor 30 is an actually circulated genuine banknote and acceptable or an unacceptable banknote such as a counterfeit banknote, a foreign banknote or the like and discriminating the denomination of the banknote when the banknote is acceptable and driving the motor 25 and the solenoid 27 based on a detection signal input from the sensor 5.

The thus constituted banknote stacking apparatus according to this preferred embodiment stacks banknotes on the banknote stacking plate 1 in the following manner.

When the operator or the customer deposits banknotes into a banknote receiving and dispensing opening (not shown) of the banknote receiving and dispensing machine and inputs an instruction signal for instructing the banknote receiving and dispensing machine to handle banknotes through the input means 20, the instruction signal is input to the control unit 40 and when the control unit 40 receives the instruction signal from the input means 20, it outputs a drive signal to the motor 25 to rotate the vane wheel 3.

As shown in FIG. 1, in this state, the first banknote press member 11 is biased by the tension spring 13 in the clockwise direction and is held at the waiting position thereof apart from the upper surface of the banknote stacking plate 1. Therefore, the second banknote press member 15 whose surface in the vicinity of the downstream end portion thereof is firmly fixed to the press surface 12*b* of the central tooth 11*b* of the first banknote press member 11 is also held at the waiting position thereof apart from the upper surface of the banknote stacking plate 1.

When a banknote deposited into the banknote receiving and dispensing machine is transported in a banknote transporting passage (not shown) and an optical pattern of the banknote and the like is detected by the banknote discriminating sensor 30 provided in the banknote transporting passage, a banknote detection signal is output from the banknote discriminating sensor 30 to the control unit 40.

When the control unit 40 judges based on the banknote detection signal input from the banknote discriminating sensor 30 that the banknote detected by the banknote discriminating sensor 30 is acceptable, the control unit 40 feeds the banknote toward the banknote stacking apparatus and the banknote is fed by the pair of rollers 2 to above the banknote stacking plate 1.

The rear end portion of the banknote fed by the pair of rollers 2 to above the banknote stacking plate 1 is scraped off by the vane wheel 3 toward the upper surface of the banknote stacking plate 1.

When the rear end portion of the banknote is detected by the sensor 5 disposed at an inlet portion of the banknote stacking apparatus, a banknote detection signal is output from the sensor 5 to the control unit 40.

When the control unit 40 receives the banknote detection signal from the sensor 5, the control unit 40 outputs a drive signal to the solenoid 27 when a predetermined time period has passed after it received the banknote detection signal.

As a result, the solenoid 27 swings the first banknote press member 11 in the counterclockwise direction in FIG. 1 about the support shaft 10 against the spring force of the tension spring 13, whereby the banknote fed above the banknote stacking plate 1 is pressed toward the inclined surface portion 1*c* of the banknote stacking plate 1 by the press surfaces 12*a*, 12*b*, 12*c* of the teeth 11*a*, 11*b*, 11*c*.

Figure 5:
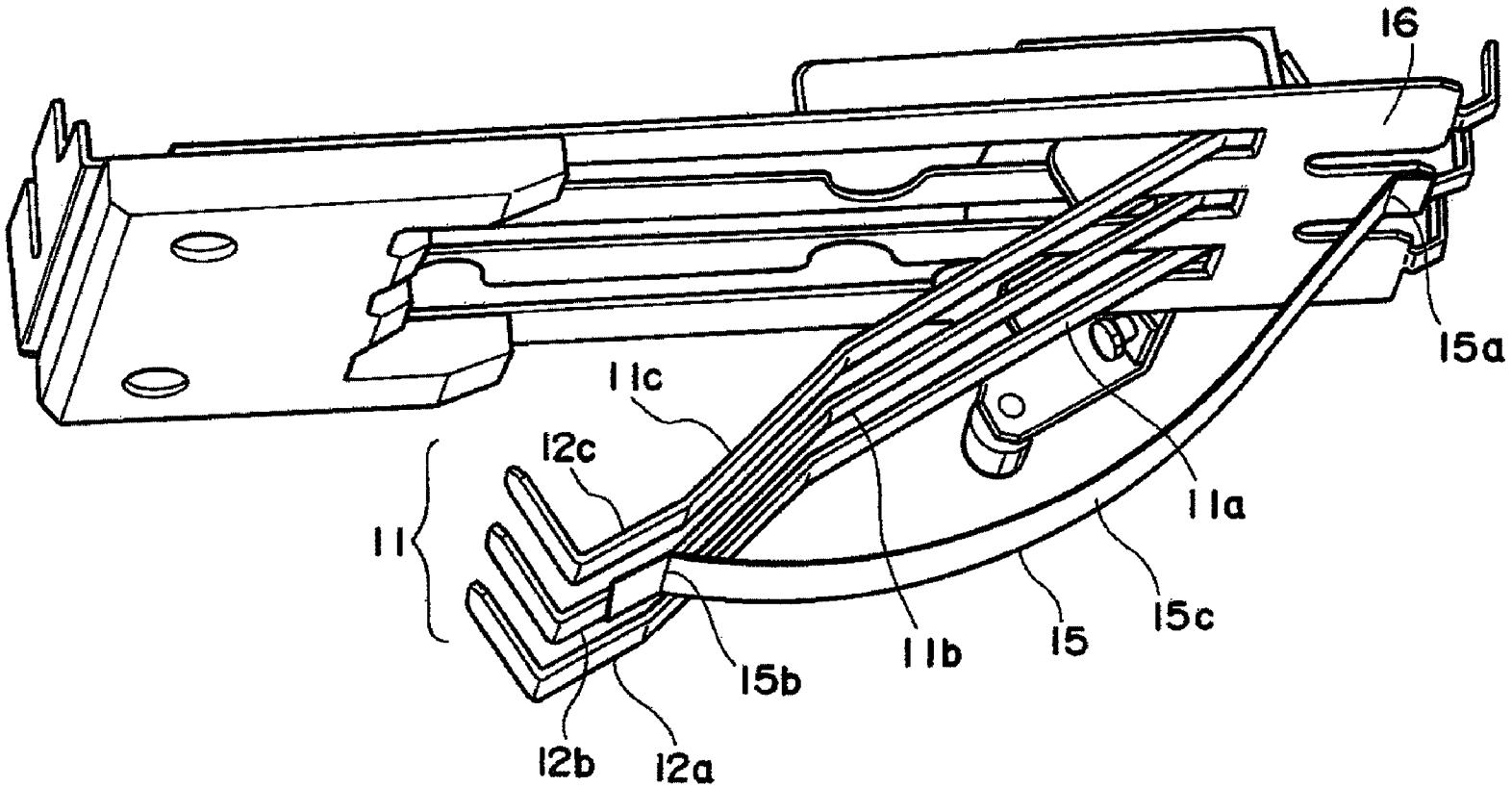
FIG. 5 is a schematic perspective view showing a first banknote press member and a second banknote press member, with the first banknote press member swung about a support shaft in the counterclockwise direction in FIG. 1.

FIG. 5 is a schematic perspective view showing the first banknote press member 11 and the second banknote press member 15 when the first banknote press member 11 is swung about the support shaft 10 in the counterclockwise direction in FIG. 1.

As described above, the surface of the second banknote press member 15 in the vicinity of the downstream end portion thereof is firmly fixed to the press surface 12*b* of the tooth 11*b* of the first banknote press member 11 and the second banknote press member 15 is formed with the crease 15*b* in contact with the portion where the second banknote press member 15 is firmly fixed to the press surface 12*b* of the tooth 11*b*. On the other hand, the surface of the second banknote press member 15 in the vicinity of the upstream end portion thereof is firmly fixed to the mounting member 16 at a position upstream of the support shaft 10 and on the side toward the banknote stacking plate 1 from the support shaft 10 and the second banknote press member 15 is formed with a crease 15*a* in contact with the portion where the second banknote press member 15 is firmly fixed to the mounting member 16. Therefore, when the first banknote press member 11 is swung counterclockwise about the support shaft 10, as shown in FIG. 5, the second banknote press member 15 is forcibly swung.

As a result, the distance between the upstream end portion and downstream end portion of the second banknote press member 15 is shortened and the second banknote press member 15 formed of a synthetic resin sheet having flexibility such as a polyethylene terephthalate sheet is consequently deformed, whereby a convex portion 15*c* is formed to project toward the banknote stacking plate 1.

Therefore, a portion of the banknote fed to above the banknote stacking plate 1 between the front end portion (downstream end portion) thereof and a portion thereof spaced apart from the front end portion by a distance equal to about one-fifth (⅕) of the length of the banknote is pressed by the first banknote press member 11 toward the inclined surface portion 1*c* of the banknote stacking plate 1 and a portion of the banknote fed to above the banknote stacking plate 1 between substantially a center portion of the banknote in the longitudinal direction thereof and the rear end portion (upstream end portion) thereof is pressed by the convex portion 15*c* of the second banknote press member 15 produced by the deformation of the second banknote press member 15 toward the first horizontal surface portion 1*a* of the banknote stacking plate 1.

In this manner, in this preferred embodiment, the portion of the banknote fed to above the banknote stacking plate 1 between the front end portion (downstream end portion) thereof and a portion thereof spaced apart from the front end portion by a distance equal to about one-fifth (⅕) of the length of the banknote is pressed by the first banknote press member 11 toward the inclined surface portion 1*c* of the banknote stacking plate 1 and the portion of the banknote fed onto the banknote stacking plate 1 between substantially the center portion of the banknote in the longitudinal direction thereof and the rear end portion (upstream end portion) thereof is pressed by the convex portion 15*c* of the second banknote press member 15 produced by the deformation of the second banknote press member 15 formed of a synthetic resin sheet having flexibility toward the first horizontal surface portion 1*a*. Therefore, even in the case where a banknote whose substantially central portion is folded or a banknote whose front end portion is curled upwardly is fed into the banknote stacking apparatus or even in the case where a banknote apt to be very easily folded or a wrinkled banknote is fed into the banknote stacking apparatus, the banknote can be stacked on the upper surface of the banknote stacking plate 1 in the desired manner.

When the banknote has been stacked on the upper surface of the banknote stacking plate 1, the control unit 40 outputs a drive stop signal to the solenoid 27, whereby the solenoid 27 is turned off.

As a result, the first banknote press member 11 is returned by the spring force of the tension spring 13 to the waiting position thereof shown in FIG. 1 and the second banknote press member 15 whose downstream end portion is firmly fixed to the first banknote press member 11 is also returned to the waiting position thereof shown in FIG. 1.

Every time the sensor 5 detects the rear end portion of a banknote and a banknote detection signal is input to the control unit 40, the control unit 40 repeats the same operation and when the control unit 40 judges that all banknotes deposited into the banknote receiving and dispensing machine and discriminated to be acceptable have been fed into the banknote stacking apparatus, the control unit 40 terminates the banknote stacking operation for stacking banknotes in the banknote stacking apparatus.

As a result, all banknotes deposited into the banknote receiving and dispensing machine and discriminated to be acceptable come to be stacked on the upper surface of the banknote stacking plate 1. In this state, when a banknote receiving signal or a banknote returning signal is input by the operator or the customer through the input means 20 and the control unit 40 receives the banknote receiving signal or the banknote returning signal, the solenoid 28 is driven to open the shutter 6 provided at an outlet portion of the banknote stacking apparatus and the stacked banknotes are taken into the banknote receiving and dispensing machine once and for all or returned to the operator or the customer in accordance with the instruction signal input by the operator or the customer.

According to this preferred embodiment, the portion of the banknote fed to above the banknote stacking plate 1 between the front end portion (downstream end portion) thereof and a portion thereof spaced apart from the front end portion by a distance equal to about one-fifth (⅕) of the length of the banknote is pressed by the first banknote press member 11 toward the inclined surface portion 1*c* of the banknote stacking plate 1 and the portion of the banknote fed to above the banknote stacking plate 1 between substantially the center portion of the banknote in a longitudinal direction thereof and the rear end portion (upstream end portion) thereof is pressed by the convex portion 15*c* of the second banknote press member 15 produced by the deformation of the second banknote press member 15 formed of a synthetic resin sheet having flexibility toward the first horizontal surface portion 1*a* of the banknote stacking plate 1, so that even in the case where a banknote whose substantially central portion is folded or a banknote whose front end portion is curled upwardly is fed into the banknote stacking apparatus or even in the case where a banknote apt to be very easily folded or a wrinkled banknote is fed into the banknote stacking apparatus, the banknote can be stacked on the upper surface of the banknote stacking plate 1 in the desired manner.

Further, according to this preferred embodiment, since the downstream end portion of the second banknote press member 15 is firmly fixed to the press surface 12*b* of the tooth 11*b* of the first banknote press member 11, when the solenoid 27 is driven to swing the first banknote press member 11 about the support shaft 10, the second banknote press member 15 is simultaneously swung. Therefore, since the first banknote press member 11 and the second banknote press member 15 can be swung in the desired manner only by driving the solenoid 27 and the banknotes fed into the banknote stacking apparatus can be stacked on the banknote stacking plate 1 in the desired manner, the structure of the banknote stacking apparatus can be markedly simplified.

Figure 6:
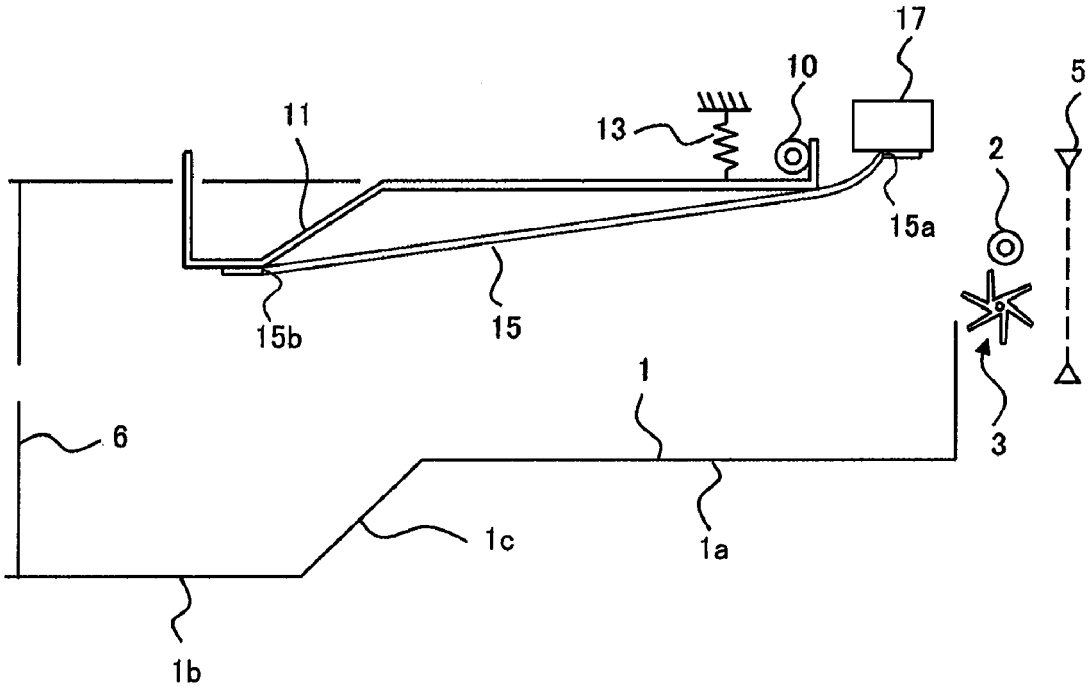
FIG. 6 is a schematic side view of a banknote stacking apparatus which is another preferred embodiment of the present invention.
Figure 7:
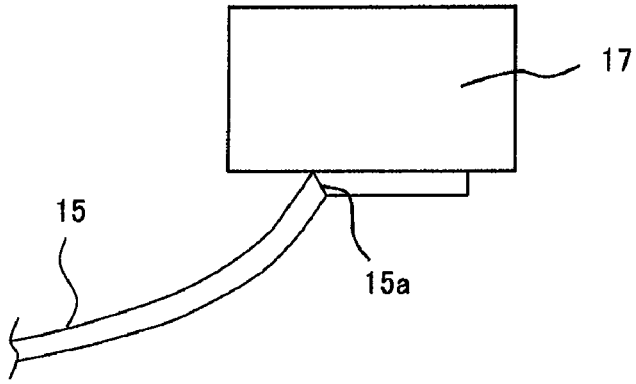
FIG. 7 is a schematic enlarged side view showing details of a portion in the vicinity of an upstream portion of a second banknote press member.

FIG. 6 is a schematic side view of a banknote stacking apparatus which is another preferred embodiment of the present invention and FIG. 7 is a schematic enlarged side view showing the details of a portion of the second banknote press member 15 in the vicinity of the upstream end portion thereof.

As shown in FIGS. 6 and 7, a banknote stacking apparatus according to this preferred embodiment has the same configuration as that of the banknote stacking apparatus shown in FIGS. 1 to 5 except that the surface of the second banknote press member 15 in the vicinity of the upstream end portion thereof is firmly fixed to a mounting member 17 at a position upstream of the support shaft 10 and in a plane parallel with a plane including the main portion of the first banknote press member 11 located at the waiting position thereof and including the support shaft 10.

Similarly to the previous preferred embodiment, the banknote stacking apparatus according to this preferred embodiment is also constituted so that an acceptable banknote is fed by the pair of rollers 2 to above the banknote stacking plate 1 and the rear end portion of the banknote is scraped off by the vane wheel 3 toward the upper surface of the banknote stacking plate 1.

When the sensor 5 provided at the inlet portion of the banknote stacking apparatus detects the rear end portion of the banknote, a banknote detection signal is output from the sensor 5 to the control unit 40.

The control unit 40 outputs a drive signal to the solenoid 27 when a predetermined time period has passed after it received the banknote detection signal from the sensor 5.

As a result, the first banknote press member 11 is swung about the support shaft 10 in the counterclockwise direction in FIG. 6 against a spring force of the tension spring 13, whereby the banknote fed to above the banknote stacking plate 1 is pressed by the press surfaces 12*a*, 12*b* and 12*c* of the teeth 11*a*, 11*b* and 11*c* toward the inclined surface portion 1*c* of the banknote stacking plate 1.

Figure 8:
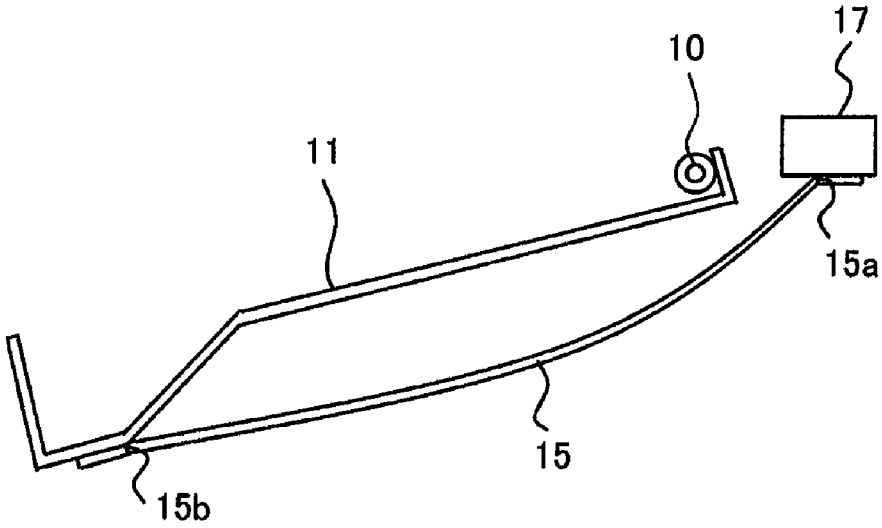
FIG. 8 is a diagram schematically showing positions and shapes of a first banknote press member and a second banknote press member, with the first banknote press member swung about a support shaft in the counterclockwise direction in FIG. 6.

FIG. 8 is a diagram schematically showing the positions of the first banknote stacking plate 11 and the second banknote stacking plate 15 when the first banknote stacking plate 11 is swung about the support shaft 10 in the counterclockwise direction in FIG. 6.

As shown in FIG. 8, when the first banknote stacking plate 11 is swung about the support shaft 10, since the downstream end portion of the second banknote press member 15 is firmly fixed to the first banknote press member 11 and the second banknote press member 15 is formed with a crease 15*b* in contact with the portion where the second banknote press member 15 is firmly fixed to the first banknote stacking plate 11, the second banknote press member 15 is forcibly swung about the crease 15*b* with the swing of the first banknote press member 11.

As a result, since the distance between the downstream end portion and the upstream end portion of the second banknote press member 15 is shortened, similarly to in the previous preferred embodiment shown in FIGS. 1 to 5, the second banknote press member 15 formed of a synthetic resin sheet having flexibility such as a polyethylene terephthalate sheet is deformed convexly toward the banknote stacking plate 1 as the first banknote press member 11 is swung about the support shaft 10 in the counterclockwise direction, whereby the banknote fed to above the upper surface of the banknote stacking plate 1 is pressed by the first banknote press member 11 at a portion of the banknote between the front end portion thereof and a portion thereof spaced from the front end portion by a distance equal to about one-fifth (⅕) of the length of the banknote toward the inclined surface portion 1*c* of the banknote stacking plate 1 and the banknote is pressed by the convex portion 15*c* of the second banknote press member 15 at a portion of the banknote between substantially a center portion thereof in the longitudinal direction of the banknote and the rear end portion thereof toward the first horizontal surface portion 1*a* of the banknote stacking plate 1.

In this manner, in this preferred embodiment, similarly to in the previous preferred embodiment shown in FIGS. 1 to 5, the portion of the banknote fed to above the banknote stacking plate 1 between the front end portion (downstream end portion) thereof and the portion thereof spaced apart from the front end portion by a distance equal to about one-fifth (⅕) of the length of the banknote is pressed by the first banknote press member 11 toward the inclined surface portion 1*c* of the banknote stacking plate 1 and the portion of the banknote fed to above the banknote stacking plate 1 between substantially the center portion of the banknote in a longitudinal direction thereof and the rear end portion (upstream end portion) thereof is pressed by the convex portion 15*c* of the second banknote press member 15 produced by the deformation of the second banknote press member 15 formed of a synthetic resin sheet having flexibility toward the first horizontal surface portion 1*a* of the banknote stacking plate 1, so that even in the case where a banknote whose substantially a central portion is folded or a banknote whose front end portion is curled upwardly is fed into the banknote stacking apparatus or even in the case where a banknote apt to be very easily folded or a wrinkled banknote is fed into the banknote stacking apparatus, the banknote can be stacked on the upper surface of the banknote stacking plate 1 in the desired manner.

When the banknote has been stacked on the upper surface of the banknote stacking plate 1, the control unit 40 outputs a drive stop signal to the solenoid 27, whereby the solenoid 27 is turned off.

As a result, the first banknote press member 11 is returned by a spring force of the tension spring 13 to the waiting position thereof shown in FIG. 6 and the second banknote press member 15 whose downstream end portion is firmly fixed to the first banknote press member 11 is also returned to the waiting position thereof shown in FIG. 6.

Every time the sensor 5 detects the rear end portion of a banknote and a banknote detection signal is input to the control unit 40, the control unit 40 repeats the same operation and when the control unit 40 judges that all banknotes deposited into the banknote receiving and dispensing machine and discriminated to be acceptable have been fed into the banknote stacking apparatus, the control unit 40 terminates the banknote stacking operation for stacking banknotes in the banknote stacking apparatus.

As a result, all banknotes deposited into the banknote receiving and dispensing machine and discriminated to be acceptable come to be stacked on the upper surface of the banknote stacking plate 1. In this state, when a banknote receiving signal or a banknote returning signal is input by the operator or the customer through the input means 20 and the control unit 40 receives the banknote receiving signal or the banknote returning signal, the solenoid 28 is driven to open the shutter 6 provided at an outlet portion of the banknote stacking apparatus and the stacked banknotes are taken into the banknote receiving and dispensing machine once and for all or returned to the operator or the customer in accordance with the instruction signal input by the operator or the customer.

According to this preferred embodiment, the portion of the banknote fed to above the banknote stacking plate 1 between the front end portion (downstream end portion) thereof and a portion thereof spaced apart from the front end portion by a distance equal to about one-fifth (⅕) of the length of the banknote is pressed by the first banknote press member 11 toward the inclined surface portion 1*c* of the banknote stacking plate 1 and the portion of the banknote fed to above the banknote stacking plate 1 between substantially the center portion of the banknote in a longitudinal direction thereof and the rear end portion (upstream end portion) thereof is pressed by the convex portion 15*c* of the second banknote press member 15 produced by the deformation of the second banknote press member 15 formed of a synthetic resin sheet having flexibility toward the first horizontal surface portion 1*a* of the banknote stacking plate 1, so that even in the case where a banknote whose substantially central portion is folded or a banknote whose front end portion is curled upwardly is fed into the banknote stacking apparatus or even in the case where a banknote apt to be very easily folded or a wrinkled banknote is fed into the banknote stacking apparatus, the banknote can be stacked on the upper surface of the banknote stacking plate 1 in the desired manner.

Further, according to this preferred embodiment, since the downstream end portion of the second banknote press member 15 is firmly fixed to the press surface 12*b* of the tooth 11*b* of the first banknote press member 11, when the solenoid 27 is driven to swing the first banknote press member 11 about the support shaft 10, the second banknote press member 15 is simultaneously swung. Therefore, since the first banknote press member 11 and the second banknote press member 15 can be swung in the desired manner only by driving the solenoid 27 and the banknotes fed into the banknote stacking apparatus can be stacked on the banknote stacking plate 1 in a desired manner, the structure of the banknote stacking apparatus can be markedly simplified.

Figure 9:
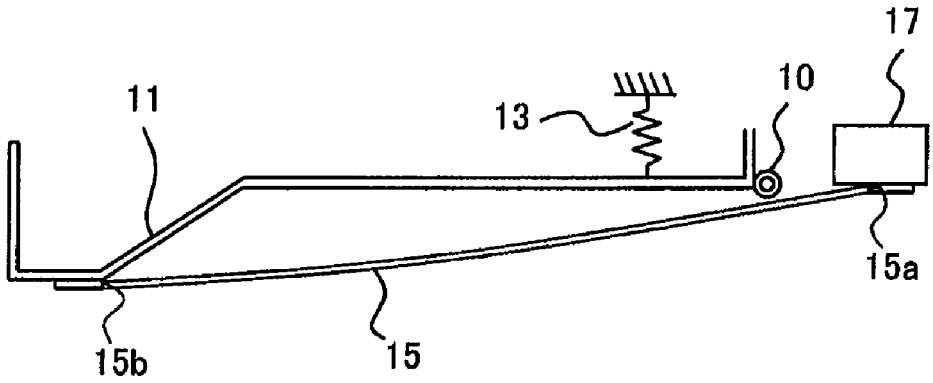
FIG. 9 is a schematic side view of a banknote stacking apparatus which is a further preferred embodiment of the present invention.

FIG. 9 is a schematic side view of a banknote stacking apparatus which is a further preferred embodiment of the present invention.

As shown in FIG. 9, a banknote stacking apparatus according to this preferred embodiment has the same configuration as that of the banknote stacking apparatus shown in FIGS. 1 to 5 except that the surface of the second banknote press member 15 in the vicinity of the upstream portion thereof is firmly fixed to a mounting member 17 at a position upstream of the support shaft 10 and in a plane including the support shaft 10 and the main portion of the first banknote press member 11.

Similarly to in the previous preferred embodiments, the banknote stacking apparatus according to this preferred embodiment is also constituted so that an acceptable banknote is fed by the pair of rollers 2 to above the banknote stacking plate 1 and the rear end portion of the banknote is scraped off by the vane wheel 3 toward the upper surface of the banknote stacking plate 1.

When the sensor 5 provided at the inlet portion of the banknote stacking apparatus detects the rear end portion of the banknote, a banknote detection signal is output from the sensor 5 to the control unit 40.

The control unit 40 outputs a drive signal to the solenoid 27 when a predetermined time period has passed after it received the banknote detection signal from the sensor 5.

As a result, the first banknote press member 11 is swung about the support shaft 10 in the counterclockwise direction in FIG. 6 against a spring force of the tension spring 13, whereby the banknote fed to above the banknote stacking plate 1 is pressed by the press surfaces 12*a*, 12*b* and 12*c* of the teeth 11*a*, 11*b* and 11*c* toward the inclined surface portion 1*c* of the banknote stacking plate 1.

Figure 10:
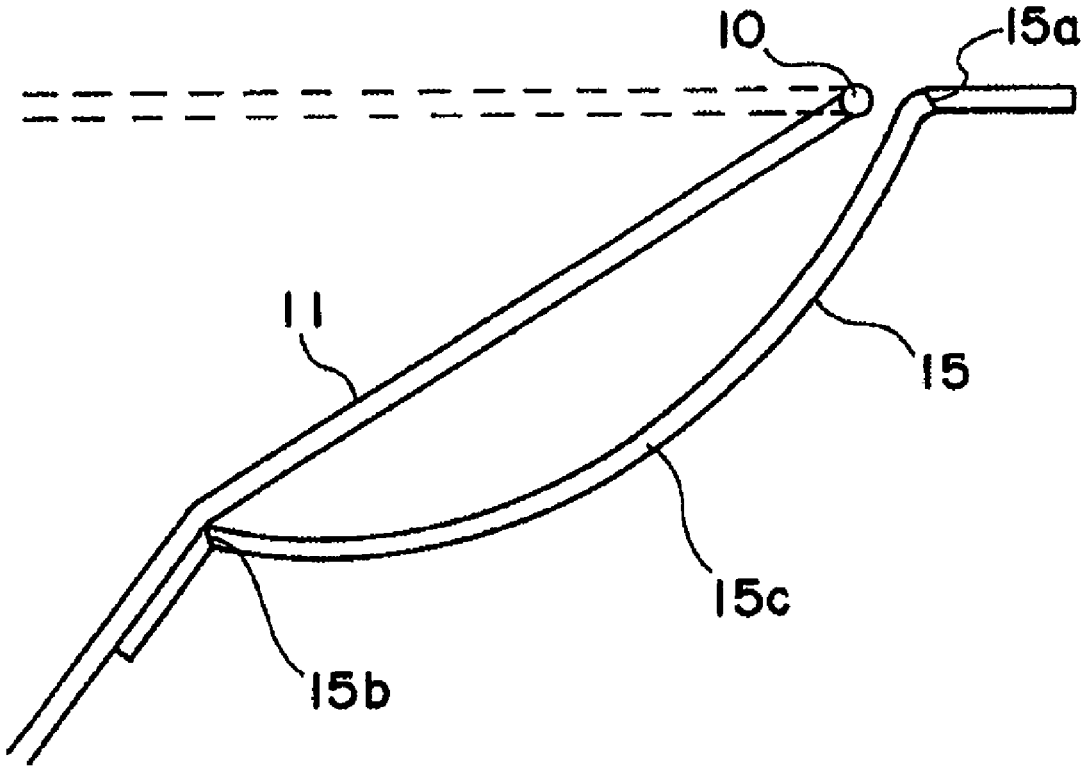
FIG. 10 is a diagram schematically showing positions and shapes of a first banknote press member and a second banknote press member, with the first banknote press member swung about a support shaft in the counterclockwise direction in FIG. 9.

FIG. 10 is a diagram showing positions and shapes of the first banknote press member 11 and the second banknote press member 15 when the first banknote press member 11 is swung about the support shaft 10 in the counterclockwise direction in FIG. 9.

As shown in FIG. 10, when the first banknote press member 11 is swung about the support shaft 10, since the downstream end portion of the second banknote press member 15 is firmly fixed to the first banknote press member 11 and the second banknote press member 15 is formed with the crease 15*b* in contact with a portion where the second banknote press member 15 is firmly fixed to the first banknote press member 11, the second banknote press member 15 is forcibly swung about the crease 15*b* as the first banknote press member 11 is swung about the support shaft 10.

As a result, since the distance between the downstream end portion of the second banknote press member 15 and the upstream end portion thereof is shortened, similarly to in the preferred embodiment shown in FIGS. 1 to 5, the second banknote press member 15 formed of a synthetic resin sheet having flexibility such as a polyethylene terephthalate sheet is consequently deformed convexly toward the banknote stacking plate 1 as the first banknote press member 11 is swung about the support shaft 10 in the counterclockwise direction, whereby the banknote fed to above the upper surface of the banknote stacking plate 1 is pressed by the first banknote press member 11 at a portion of the banknote between the front end portion thereof and a portion thereof spaced from the front end portion by a distance equal to about one-fifth (1/5) of the length of the banknote toward the inclined surface portion 1*c* of the banknote stacking plate 1 and the banknote is pressed by the convex portion 15*c* of the second banknote press member 15 at a portion of the banknote between substantially a center portion thereof in the longitudinal direction of the banknote and the rear end portion thereof toward the first horizontal surface portion 1*a* of the banknote stacking plate 1.

In this manner, in this preferred embodiment, similarly to in the previous preferred embodiment shown in FIGS. 1 to 5, the portion of the banknote fed to above the banknote stacking plate 1 between the front end portion (downstream end portion) thereof and the portion thereof spaced apart from the front end portion by a distance equal to about one-fifth (1/5) of the length of the banknote is pressed by the first banknote press member 11 toward the inclined surface portion 1*c* of the banknote stacking plate 1 and the portion of the banknote fed to above the banknote stacking plate 1 between substantially the center portion of the banknote in the longitudinal direction thereof and the rear end portion (upstream end portion) thereof is pressed by the convex portion 15*c* of the second banknote press member 15 produced by the deformation of the second banknote press member 15 formed of a synthetic resin sheet having flexibility toward the first horizontal surface portion 1*a* of the banknote stacking plate 1, so that even in the case where a banknote whose substantially central portion is folded or a banknote whose front end portion is curled upwardly is fed into the banknote stacking apparatus or even in the case where a banknote apt to be very easily folded or a wrinkled banknote is fed into the banknote stacking apparatus, the banknote can be stacked on the upper surface of the banknote stacking plate 1 in the desired manner.

When the banknote has been stacked on the upper surface of the banknote stacking plate 1, the control unit 40 outputs a drive stop signal to the solenoid 27, whereby the solenoid 27 is turned off.

As a result, the first banknote press member 11 is returned by the spring force of the tension spring 13 to the waiting position thereof shown in FIG. 6 and the second banknote press member 15 whose downstream end portion is firmly fixed to the first banknote press member 11 is also returned to the waiting position thereof shown in FIG. 9.

Every time the sensor 5 detects the rear end portion of a banknote and a banknote detection signal is input to the control unit 40, the control unit 40 repeats the same operation and when the control unit 40 judges that all banknotes deposited into the banknote receiving and dispensing machine and discriminated to be acceptable have been fed into the banknote stacking apparatus, the control unit 40 terminates the banknote stacking operation for stacking banknotes in the banknote stacking apparatus.

As a result, all banknotes deposited into the banknote receiving and dispensing machine and discriminated to be acceptable come to be stacked on the upper surface of the banknote stacking plate 1. In this state, when a banknote receiving signal or a banknote returning signal is input by the operator or the customer through the input means 20 and the control unit 40 receives the banknote receiving signal or the banknote returning signal, the solenoid 28 is driven to open the shutter 6 provided at the outlet portion of the banknote stacking apparatus and the stacked banknotes are taken into the banknote receiving and dispensing machine once and for all or returned to the operator or the customer in accordance with the instruction signal input by the operator or the customer.

According to this preferred embodiment, the portion of the banknote fed to above the banknote stacking plate 1 between the front end portion (downstream end portion) thereof and a portion thereof spaced apart from the front end portion by a distance equal to about one-fifth (⅕) of the length of the banknote is pressed by the first banknote press member 11 toward the inclined surface portion 1*c* of the banknote stacking plate 1 and the portion of the banknote fed to above the banknote stacking plate 1 between substantially the center portion of the banknote in a longitudinal direction thereof and the rear end portion (upstream end portion) thereof is pressed by the convex portion 15*c* of the second banknote press member 15 produced by the deformation of the second banknote press member 15 formed of a synthetic resin sheet having flexibility toward the first horizontal surface portion 1*a* of the banknote stacking plate 1, so that even in the case where a banknote whose substantially central portion is folded or a banknote whose front end portion is curled upwardly is fed into the banknote stacking apparatus or even in the case where a banknote apt to be very easily folded or a wrinkled banknote is fed into the banknote stacking apparatus, the banknote can be stacked on the upper surface of the banknote stacking plate 1 in the desired manner.

Further, according to this preferred embodiment, since the downstream end portion of the second banknote press member 15 is firmly fixed to the press surface 12*b* of the tooth 11*b* of the first banknote press member 11, when the solenoid 27 is driven to swing the first banknote press member 11 about the support shaft 10, the second banknote press member 15 is simultaneously swung. Therefore, since the first banknote press member 11 and the second banknote press member 15 can be swung in the desired manner only by driving the solenoid 27 and the banknotes fed into the banknote stacking apparatus can be stacked on the banknote stacking plate 1 in the desired manner, the structure of the banknote stacking apparatus can be markedly simplified.

Figure 11:
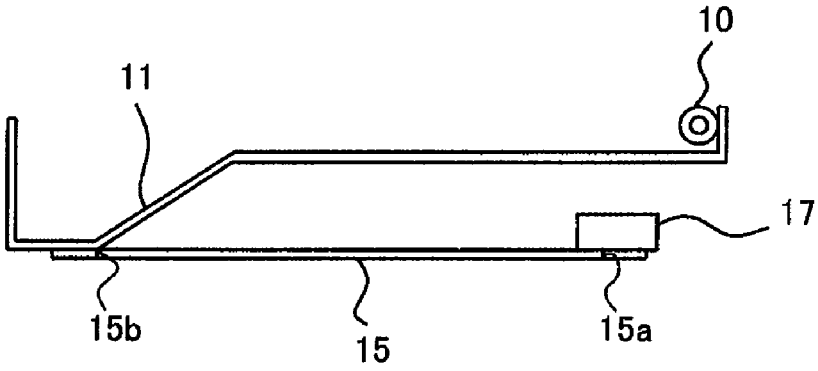
FIG. 11 is a schematic side view of a banknote stacking apparatus which is a further preferred embodiment of the present invention.

FIG. 11 is a schematic side view of a banknote stacking apparatus which is a further preferred embodiment of the present invention.

As shown in FIG. 11, a banknote stacking apparatus according to this preferred embodiment has the same configuration as the banknote stacking apparatus shown in FIGS. 1 to 5 except that the surface of the second banknote press member 15 in the vicinity of the upstream end portion thereof is firmly fixed to a mounting member 17 secured to the body of the banknote stacking apparatus at a position downstream of the support shaft 10 and on the side toward the banknote stacking plate 1 from a plane parallel with a plane including the main portion of the first banknote press member 11 and including the support shaft 10.

Similarly to in the previous preferred embodiment, the banknote stacking apparatus according to this preferred embodiment is also constituted so that an acceptable banknote is fed by the pair of rollers 2 to above the banknote stacking plate 1 and the rear end portion of the banknote is scraped off by the vane wheel 3 toward the upper surface of the banknote stacking plate 1.

When the sensor 5 provided at the inlet portion of the banknote stacking apparatus detects the rear end portion of the banknote, a banknote detection signal is output from the sensor 5 to the control unit 40.

The control unit 40 outputs a drive signal to the solenoid 27 when a predetermined time period has passed after it received the banknote detection signal from the sensor 5.

As a result, the first banknote press member 11 is swung about the support shaft 10 in the counterclockwise direction in FIG. 6 against a spring force of the tension spring 13, whereby the banknote fed onto the banknote stacking plate 1 is pressed by the press surfaces 12*a*, 12*b* and 12*c* of the teeth 11*a*, 11*b* and 11*c* toward the inclined surface portion 1*c* of the banknote stacking plate 1.

Figure 12:
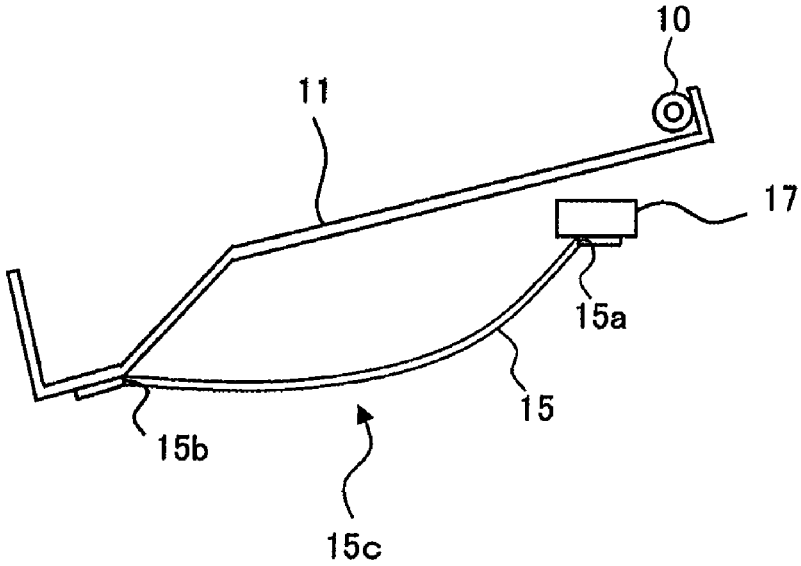
FIG. 12 is a diagram schematically showing positions and shapes of a first banknote press member and a second banknote press member, with the first banknote press member swung about a support shaft in the counterclockwise direction in FIG. 11.

FIG. 12 is a side view schematically showing the positions and shapes of the first banknote press member 11 and the second banknote press member 15 when the first banknote press member 11 is swung about the support shaft 10 in the counterclockwise direction in FIG. 11.

As shown in FIG. 12, when the first banknote stacking plate 11 is swung about the support shaft 10, since the downstream end portion of the second banknote press member 15 is firmly fixed to the first banknote press member 11 and the second banknote press member 15 is formed with a crease 15*b* in contact with the portion where the second banknote press member 15 is firmly fixed to the first banknote stacking plate 11, the second banknote press member 15 is forcibly swung about the crease 15*b* with the swing of the first banknote press member 11.

As a result, since the distance between the downstream end portion and the upstream end portion of the second banknote press member 15 is shortened, similarly to in the previous preferred embodiment shown in FIGS. 1 to 5, the second banknote press member 15 formed of a synthetic resin sheet having flexibility such as a polyethylene terephthalate sheet is deformed convexly toward the banknote stacking plate 1 as the first banknote press member 11 is swung about the support shaft 10 in the counterclockwise direction, whereby the banknote fed onto the upper surface of the banknote stacking plate 1 is pressed by the first banknote press member 11 at a portion of the banknote between the front end portion thereof and a portion spaced from the front end portion thereof by a distance equal to about one-fifth (⅕) of the length of the banknote toward the inclined surface portion 1*c* of the banknote stacking plate 1 and the banknote is pressed by the convex portion 15*c* of the second banknote press member 15 at a portion of the banknote between substantially a center portion thereof in the longitudinal direction of the banknote and the rear end portion thereof toward the first horizontal surface portion 1*a* of the banknote stacking plate 1.

In this manner, in this preferred embodiment, similarly to in the previous preferred embodiment shown in FIGS. 1 to 5, the portion of the banknote fed onto the upper surface of the banknote stacking plate 1 between the front end portion (downstream end portion) thereof and the portion thereof spaced apart from the front end portion by a distance equal to about one-fifth (⅕) of the length of the banknote is pressed by the first banknote press member 11 toward the inclined surface portion 1*c* of the banknote stacking plate 1 and the portion of the banknote fed onto the banknote stacking plate 1 between substantially the center portion of the banknote in a longitudinal direction thereof and the rear end portion (upstream end portion) thereof is pressed by the convex portion 15*c* of the second banknote press member 15 produced by the deformation of the second banknote press member 15 formed of a synthetic resin sheet having flexibility toward the first horizontal surface portion 1*a* of the banknote stacking plate 1, so that even in the case where a banknote whose substantially a central portion is folded or a banknote whose front end portion is curled upwardly is fed into the banknote stacking apparatus or even in the case where a banknote apt to be very easily folded or a wrinkled banknote is fed into the banknote stacking apparatus, the banknote can be stacked on the upper surface of the banknote stacking plate 1 in the desired manner.

Further, in this preferred embodiment, since the downstream end portion of the second banknote press member 15 is firmly fixed to the press surface 12*b* of the tooth 11*b* of the first banknote press member 11, when the solenoid 27 is driven to swing the first banknote press member 11 about the support shaft 10, the second banknote press member 15 is simultaneously swung. Therefore, since the first banknote press member 11 and the second banknote press member 15 can be swung in the desired manner only by driving the solenoid 27 and the banknotes fed into the banknote stacking apparatus can be stacked on the banknote stacking plate 1 in the desired manner, the structure of the banknote stacking apparatus can be markedly simplified.

When the banknote has been stacked on the upper surface of the banknote stacking plate 1, the control unit 40 outputs a drive stop signal to the solenoid 27, whereby the solenoid 27 is turned off.

As a result, the first banknote press member 11 is returned by the spring force of the tension spring 13 to the waiting position thereof shown in FIG. 6 and the second banknote press member 15 whose downstream end portion is firmly fixed to the first banknote press member 11 is also returned to the waiting position thereof shown in FIG. 11.

Every time the sensor 5 detects the rear end portion of a banknote and a banknote detection signal is input to the control unit 40, the control unit 40 repeats the same operation and when the control unit 40 judges that all banknotes deposited into the banknote receiving and dispensing machine and discriminated to be acceptable have been fed into the banknote stacking apparatus, the control unit 40 terminates the banknote stacking operation for stacking banknotes in the banknote stacking apparatus.

As a result, all banknotes deposited into the banknote receiving and dispensing machine and discriminated to be acceptable come to be stacked on the upper surface of the banknote stacking plate 1. In this state, when a banknote receiving signal or a banknote returning signal is input by the operator or the customer through the input means 20 and the control unit 40 receives the banknote receiving signal or the banknote returning signal, the solenoid 28 is driven to open the shutter 6 provided at the outlet portion of the banknote stacking apparatus and the stacked banknotes are taken into the banknote receiving and dispensing machine once and for all or returned to the operator or the customer in accordance with the instruction signal input by the operator or the customer.

Figure 13:
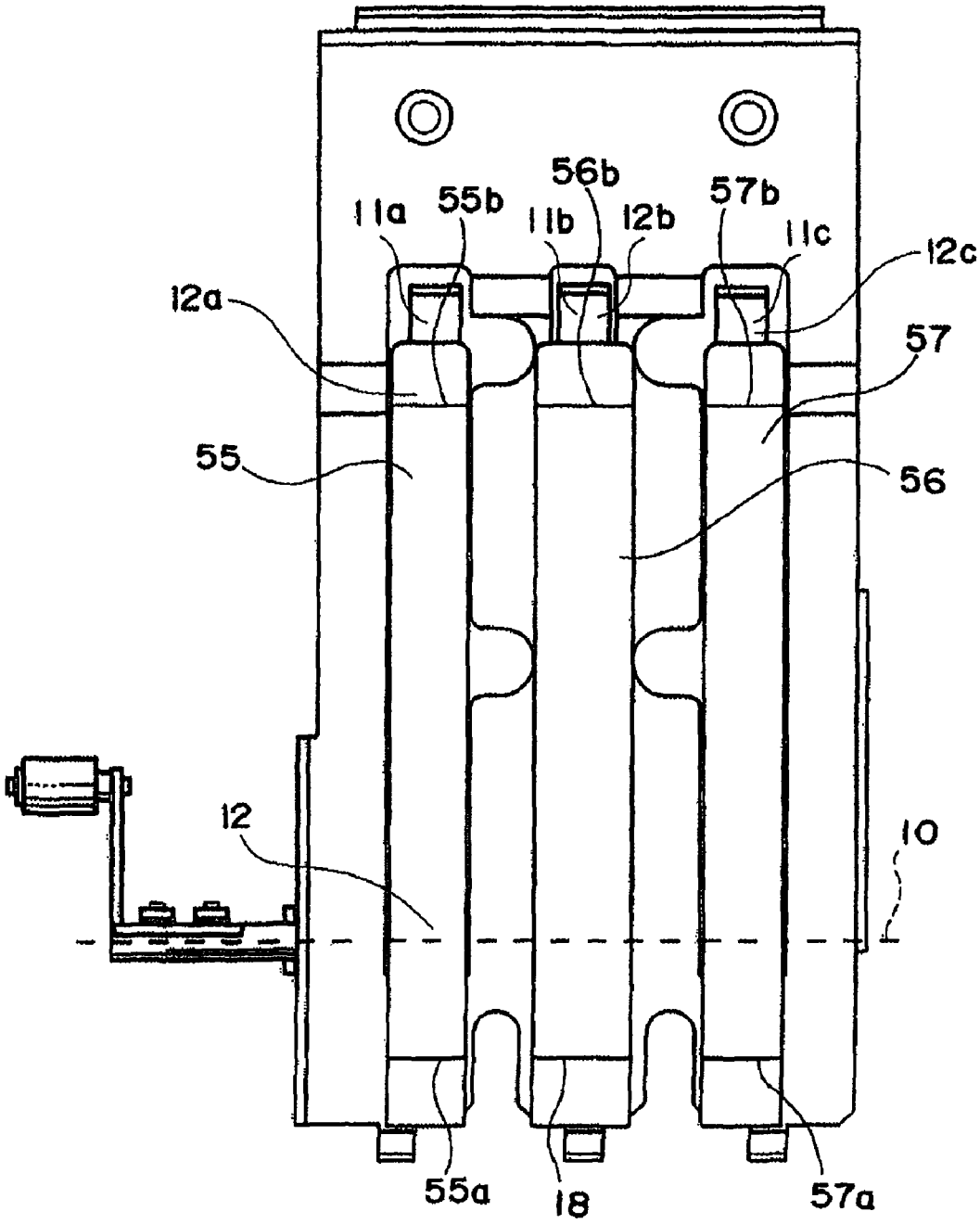
FIG. 13 is a schematic plan view showing an arrangement of a first banknote press member and a second banknote press member of a banknote stacking apparatus which is a further preferred embodiment of the present invention.
Figure 14:
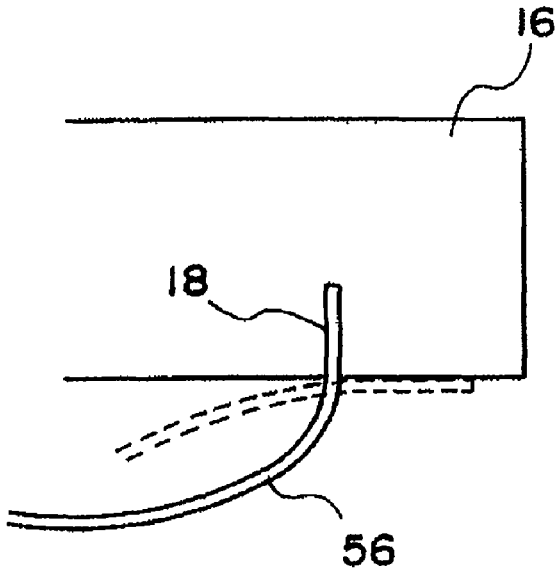
FIG. 14 is a schematic side view showing a portion of a second banknote press member which, among multiple second banknote press members shown in FIG. 13, is located at the central portion of a banknote stacking apparatus in the vicinity of an upstream end portion thereof.

FIG. 13 is a schematic front view showing the arrangement of a first banknote press member 11 and second banknote press members 55, 56 and 57 of a banknote stacking apparatus which is a further preferred embodiment of the present invention and FIG. 14 is a diagram schematically showing a portion of a second banknote press member in the vicinity of an upstream end portion located at a central position of the banknote stacking apparatus shown in FIG. 13.

As shown in FIG. 13, in the banknote stacking apparatus according to this preferred embodiment, three second banknote press members 55, 56, 57 have the same length and each of the second banknote press members 55, 56 and 57 is attached to one of the three parallel teeth 11*a*, 11*b* and 11*c* extending from the base end portion 12 of the first banknote stacking plate 11.

Each of the three second banknote press members 55, 56 and 57 is firmly fixed to one of the press surfaces 12*a*, 12*b* and 12*c* of the teeth 11*a*, 11*b* and 11*c* of the first banknote press member 11 at the surface in the vicinity of the downstream end portion thereof and each of the three second banknote press members 55, 56 and 57 is formed with a crease 55*b*, 56*b*, 57*b* in contact with the portion where it is firmly fixed to one of the press surfaces 12*a*, 12*b* and 12*c*.

On the other hand, each of the second banknote press members 55 and 57 disposed on the opposite sides among the three second banknote press members 55, 56 and 57 is firmly fixed to the mounting member 16 so that the surface in the vicinity of the upstream end portion thereof is firmly fixed to the mounting member 16 at a position upstream of the support shaft 10 and on the side toward the banknote stacking plate 1 from the support shaft 10 and each of the second banknote press members 55 and 57 is formed with a crease 55*a*, 57*a* in contact with the portion where it is firmly fixed to the mounting member 16. On the other hand, as shown in FIG. 14, the upstream end portion of the second banknote press member 56 disposed at a central portion is inserted into a slit 18 formed in the mounting member 16 upstream of the support shaft 10 and firmly fixed to a linear region on an inner surface of the slit 18.

Other configurations of the banknote stacking apparatus according to this preferred embodiment are substantially the same as those of the banknote stacking apparatus shown in FIGS. 1 to 5.

Similarly to in the previous preferred embodiments, the banknote stacking apparatus according to this preferred embodiment is also constituted so that a banknote discriminated to be acceptable is fed by the pair of rollers 2 to above the banknote stacking plate 1 and the rear end portion of the banknote is scraped off by the vane wheel 3 toward the upper surface of the banknote stacking plate 1.

When the sensor 5 provided at the inlet portion of the banknote stacking apparatus detects the rear end portion of the banknote, a banknote detection signal is output from the sensor 5 to the control unit 40.

The control unit 40 outputs a drive signal to the solenoid 27 when a predetermined time period has passed after it received the banknote detection signal from the sensor 5.

As a result, the first banknote press member 11 is swung about the support shaft 10 in the counterclockwise direction in FIG. 1 against the spring force of the tension spring 13, whereby the banknote fed to above the banknote stacking plate 1 is pressed by the press surfaces 12*a*, 12*b* and 12*c* of the teeth 11*a*, 11*b* and 11*c* of the first banknote press member 11 toward the inclined surface portion 1*c* of the banknote stacking plate 1.

Figure 15:
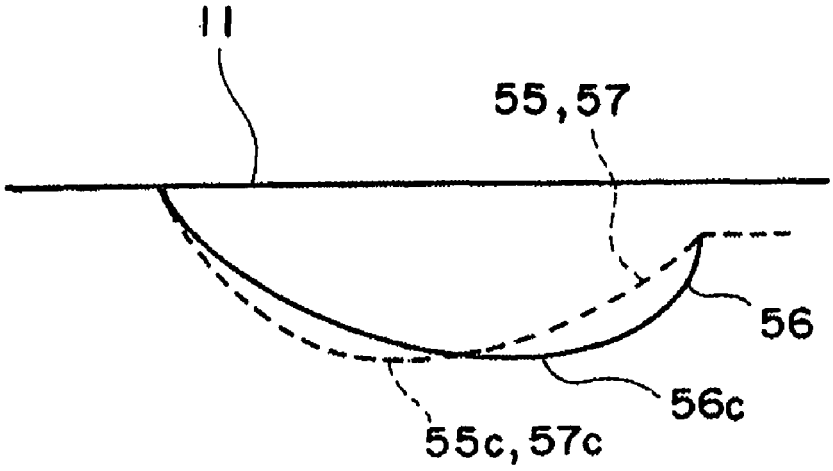
FIG. 15 is a diagram schematically showing a deformed shape of a second banknote press member located at a central portion and deformed shapes of second banknote press members located at opposite end portions when a first banknote press member is swung about a support shaft in the counterclockwise direction in FIG. 1.

FIG. 15 is a diagram schematically showing the deformed shape of the second banknote press member 56 disposed at a central portion and the deformed shapes of the second banknote press members 55 and 57 disposed on the opposite sides when the solenoid 27 is driven, whereby the first banknote press member 11 is swung about the support shaft 10 in the counterclockwise direction in FIG. 1 against a spring force of the tension spring 13.

In FIG. 15, the deformed shape of the second banknote press member 56 whose upstream end portion is inserted into the slit 18 formed in the mounting member 16 upstream of the support shaft 10 and firmly fixed to the inner surface of the slit 18 is shown by a solid line and the deformed shape of each of the second banknote press members 55 and 57 whose surface in the vicinity of the upstream end portion thereof is fixed to the mounting member 16 is shown by a dot line.

As shown in FIG. 13, the surface of each of the second banknote press members 55 and 57 in the vicinity of the downstream end portion thereof is firmly fixed to one of the teeth 11*a*, 11*c* of the first banknote press member 11 disposed on the opposite sides and each of the second banknote press members 55 and 57 is formed with one of the creases 55*b*, 57*b* in contact with a portion where the surface in the vicinity of the downstream end portion thereof is firmly fixed to the first banknote press member 11. On the other hand, the surface of each of the second banknote press members 55 and 57 in the vicinity of the upstream end portion thereof is firmly fixed to the mounting member 16 at a position upstream of the support shaft 10 and on the side toward the banknote stacking plate 1 from the support shaft 10 and each of the second banknote press members 55 and 57 is formed with one of the creases 55*a*, 57*a* in contact with a portion where the surface in the vicinity of the upstream end portion thereof is fixed to the mounting member 16. Therefore, as shown in FIG. 15, when the first banknote press member 11 is swung, each of the second banknote press members 55 and 57 is deformed in such a manner that the deformed shape of each of the second banknote press members 55 and 57 is line symmetric with respect to a straight line passing through the center portion thereof in the longitudinal direction and the convex portions 55*c*, 57*c* formed in each of the second banknote press members 55 and 57 becomes maximum at the center portion thereof in the longitudinal direction.

To the contrary, the surface of the second banknote press member 56 in the vicinity of the downstream end portion thereof is firmly fixed to the central tooth 11*b* of the first banknote press member 11 and the second banknote press member 56 is formed with a crease 56*b* in contact with a portion where the surface in the vicinity of the downstream end portion thereof is firmly fixed to the first banknote press member 11. On the other hand, the upstream end portion of the second banknote press member 56 is inserted into the slit 18 formed in the mounting member 16 at a position upstream of the support shaft 10 and on the side toward the banknote stacking plate 1 from the support shaft 10 and firmly fixed to the inner surface of the slit 18. Therefore, since the upstream end portion and the downstream end portion of the second banknote press member 56 are fixed in different manners, the deformed shape of the second banknote press member 56 is not line symmetric with respect to a straight line passing through a center portion of the second banknote press member 56 in the longitudinal direction and the position of the convex portion 56*c* where the deformation of the second banknote press member 56 becomes maximum is deviated toward the upstream end portion thereof.

Therefore, when the first banknote press member 11 is driven by the solenoid 27, a portion of the banknote fed to above the banknote stacking plate 1 between the front end portion thereof and a portion spaced apart from the front end portion thereof by a distance equal to about one-fifth (⅕) of the length of the banknote is pressed by the press surface portions 12*a*, 12*b* and 12*c* of the first banknote press member 11. On the other hand, the second banknote press members 55, 57 press a portion of the banknote fed to above the banknote stacking plate 1 between substantially the center portion of the banknote in the longitudinal direction thereof and the rear end portion (upstream portion) thereof and relatively closer to the center portion and the second banknote press member 56 presses a portion of the banknote fed to above the banknote stacking plate 1 between substantially the center portion of the banknote in the longitudinal direction thereof and the rear end portion (upstream portion) thereof and relatively closer to the rear end portion. Therefore, it is possible to stack banknotes fed to above the banknote stacking plate 1 on the banknote stacking plate 1 in the desired manner.

When the banknote has been stacked on the upper surface of the banknote stacking plate 1, the control unit 40 outputs a drive stop signal to the solenoid 27, whereby the solenoid 27 is turned off.

As a result, the first banknote press member 11 is returned by the spring force of the tension spring 13 to the waiting position thereof shown in FIG. 1 and the second banknote press members 55, 56, 57 whose downstream end portions are firmly fixed to the first banknote press member 11 are also returned to the waiting position thereof shown in FIG. 1.

Every time the sensor 5 detects the rear end portion of a banknote and a banknote detection signal is input to the control unit 40, the control unit 40 repeats the same operation and when the control unit 40 judges that all banknotes deposited into the banknote receiving and dispensing machine and discriminated to be acceptable have been fed into the banknote stacking apparatus, the control unit 40 terminates the banknote stacking operation for stacking banknotes in the banknote stacking apparatus.

As a result, all banknotes deposited into the banknote receiving and dispensing machine and discriminated to be acceptable come to be stacked on the upper surface of the banknote stacking plate 1. In this state, when a banknote receiving signal or a banknote returning signal is input into the input means 20 by the operator or the customer and the control unit 40 receives the banknote receiving signal or the banknote returning signal, the solenoid 28 is driven to open the shutter 6 provided at an outlet portion of the banknote stacking apparatus and the stacked banknotes are received in the banknote receiving and dispensing machine once and for all or returned to the operator or the customer in accordance with the instruction signal input by the operator or the customer.

According to this preferred embodiment, since the portion of the banknote fed to above the banknote stacking plate 1 between the front end portion (downstream end portion) thereof and a portion thereof spaced apart from the front end portion by a distance equal to about one-fifth (⅕) of the length of the banknote is pressed by the first banknote press member 11 toward the inclined surface portion 1*c* of the banknote stacking plate 1. On the other hand, the portion of the banknote fed to above the banknote stacking plate 1 between substantially the center portion of the banknote in the longitudinal direction thereof and the rear end of the banknote is pressed by the second banknote press members 55 and 57 disposed on the opposite ends toward the first horizontal surface portion 1*a* of the banknote stacking plate 1 and a portion of the banknote fed to the portion above the banknote stacking plate 1 between substantially the center portion of the banknote in the longitudinal direction thereof and the rear end portion thereof and relatively closer to the rear end portion is pressed by the central second banknote press member 56 toward the first horizontal surface portion 1*a*. Therefore, even in the case where a banknote whose substantially central portion is folded or a banknote whose front end portion is curled upwardly is fed into the banknote stacking apparatus or even in the case where a banknote apt to be very easily folded or a wrinkled banknote is fed into the banknote stacking apparatus, banknotes can be stacked on the upper surface of the banknote stacking plate 1 in the desired manner.

Further, according to this preferred embodiment, since each of the downstream end portions of the second banknote press members 55, 56, 57 is firmly fixed to one of the teeth 11*a*, 11*b*, 11*c* of the first banknote press member 11, when the solenoid 27 is driven to swing the first banknote press member 11 about the support shaft 10, the second banknote press members 55, 56, 57 are also swung. Therefore, since not only the first banknote press member 11 but also the second banknote press members 55, 56, 57 can be swung only by driving the solenoid 27 and banknotes fed into the banknote stacking apparatus can be stacked on the upper surface of the banknote stacking plate 1 in the banknote stacking apparatus in the desired manner, it is possible to markedly simplify the structure of the banknote stacking apparatus.

The present invention has thus been shown and described with reference to specific preferred embodiments. However, it should be noted that the present invention is in no way limited to the details of the described arrangements but changes and modifications may be made without departing from the scope of the appended claims.

For example, in the above described preferred embodiments, although explanation is made as to a banknote stacking apparatus, the present invention is not limited to a banknote stacking apparatus and can be widely applied to apparatuses for stacking sheets.

Further, in the above described preferred embodiments, although substantially horizontally-oriented banknotes are stacked, the present invention is not limited to a banknote stacking apparatus for stacking horizontally-oriented banknotes but the present invention can be applied to a banknote stacking apparatus for stacking obliquely-oriented banknotes.

Furthermore, in the above described preferred embodiments, although a synthetic resin sheet having flexibility such as a polyethylene terephthalate sheet is employed as the second banknote press members 15, 55, 56, 57, it is not absolutely necessary to use a synthetic resin sheet such as a polyethylene terephthalate sheet but it is sufficient to form the second banknote press members 15, 55, 56, 57 of a sheet having flexibility and instead of a synthetic resin sheet, a thin metal sheet having flexibility can be employed, for example.

Further, in the preferred embodiment shown in FIGS. 11 and 12, although the surface of the second banknote press member 15 in the vicinity of the upstream end portion thereof is firmly fixed to a mounting member 17 secured to the body of the banknote stacking apparatus at a position downstream of the support shaft 10 and on the side toward the banknote stacking plate 1 from a plane parallel with a plane including the main portion, the surface of the second banknote press member 15 in the vicinity of the upstream end portion thereof may be firmly fixed to a mounting member 17 secured to the body of the banknote stacking apparatus at a position downstream of the support shaft 10 and on the side toward the banknote stacking plate 1 from a plane parallel with a plane including the main portion and the support shaft 10.

Moreover, in the preferred embodiment shown in FIGS. 1 to 5, the surface of the second banknote press member 15 formed of a synthetic resin sheet having flexibility such as a polyethylene terephthalate sheet in the vicinity of the upstream end portion thereof is firmly fixed to the mounting member 16 at a position upstream of the support shaft 10 and on the side toward the banknote stacking plate 1 from the support shaft 10, and in the preferred embodiment shown in FIGS. 6 to 8, the surface of the second banknote press member 15 formed of a synthetic resin sheet having flexibility such as a polyethylene terephthalate sheet in the vicinity of the upstream end portion thereof is firmly fixed to the mounting member 17 at a position in the plane parallel with the plane including the main portion of the first banknote press member 11 positioned at the waiting position thereof and including the support shaft 10 and upstream of the support shaft 10. Further, in the preferred embodiment shown in FIGS. 9 to 10, the surface of the second banknote press member 15 formed of a synthetic resin sheet having flexibility such as a polyethylene terephthalate sheet in the vicinity of the upstream end portion thereof is firmly fixed to the mounting member 17 at a position in the plane including the support shaft 10 and the main portion of the first banknote press member 11 positioned at the waiting position thereof and, in the preferred embodiment shown in FIGS. 11 and 12, the surface of the second banknote press member 15 formed of a synthetic resin sheet having flexibility such as a polyethylene terephthalate sheet in the vicinity of the upstream end portion thereof is firmly fixed to the mounting member 17 secured to the body of the banknote stacking apparatus at a position downstream of the support shaft 10 and on the side toward the banknote stacking plate 1 from a plane parallel with the plane including the main portion of the first banknote press member 11 and including the support shaft 10. Furthermore, in the preferred embodiment shown in FIGS. 13 to 15, each of the upstream end portions of the second banknote press members 55, 56, 57 each being formed of a synthetic resin sheet having flexibility such as a polyethylene terephthalate sheet is firmly fixed to the mounting member 16 at a position upstream of the support shaft 10 and on the side toward the banknote stacking plate 1 from the support shaft 10. However, it is sufficient that when the first banknote press member 11 is swung about the support shaft 10 in the counterclockwise direction, each of the second banknote press members 15, 55, 56, 57 formed of a synthetic resin sheet having flexibility such as a polyethylene terephthalate sheet is also swung, whereby the distance between the downstream end portion of each of the second banknote press members 15, 55, 56, 57 mounted on the first banknote press member 11 and the upstream end portion thereof mounted on the body of the banknote stacking apparatus is shortened and it is not absolutely necessary to firmly fix the surface of the second banknote press member 15 in the vicinity of the upstream end portion thereof to the mounting member 16 at a position upstream of the support shaft 10 and on the side toward the banknote stacking plate 1 from the support shaft 10, firmly fix the surface of the second banknote press member 15 in the vicinity of the upstream end portion thereof to the mounting member 17 at a position in the plane parallel with a plane including the main portion of the first banknote press member 11 positioned at the waiting position thereof and including the support shaft 10 and upstream of the support shaft 1, firmly fix the surface of the second banknote press member 15 in the vicinity of the upstream end portion thereof to the mounting member 17 at a position in the plane including the support shaft 10 and the main portion of the first banknote press member 11 positioned at the waiting position thereof, firmly fix the surface of the second banknote press member 15 in the vicinity of the upstream end portion thereof to the mounting member 17 at a position downstream of the support shaft 10 and on the side toward the banknote stacking plate 1 from the plane parallel with the plane including the main portion of the first banknote press member 11 and including the support shaft 10, or firmly fix each of the upstream end portions of the second banknote press members 55, 56, 57 to the mounting member 16 at a position upstream of the support shaft 10 and on the side toward the banknote stacking plate 1 from the support shaft 10. Thus, the position where the upstream end portion of each of the second banknote press members 15, 55, 56 and 57 is firmly fixed is not particularly limited.

Further, in the above described preferred embodiments, although the first banknote press member 11 has a fork-shape and includes the three teeth 11*a*, 11*b*, 11*c*, it is not absolutely necessary for the first banknote press member 11 to include three teeth 11*a*, 11*b*, 11*c* and the number of the teeth of the first banknote press member 11 can be arbitrarily determined. Further, it is not absolutely necessary for the first banknote press member 11 to be fork-shaped and it is possible to form the first banknote press member 11 of a single flat plate.

Furthermore, the downstream end portion of the second banknote press member 15 is mounted only on the central tooth 11*b* of the fork-shaped first banknote press member 11 in the preferred embodiment shown in FIGS. 1 to 5, the preferred embodiment shown in FIGS. 6 to 8, the preferred embodiment shown in FIGS. 9 and 10 and the preferred embodiment shown in FIGS. 11 and 12 and the downstream end portion of each of the second banknote press members 55, 56, 57 having the same length is mounted on one of the teeth 11*a*, 11*b*, 11*c* of the fork-shaped first banknote press member 11 in the preferred embodiment shown in FIGS. 13 to 15. However, the downstream end portions of only the two second banknote press members 55 and 57 having the same length may be mounted on the teeth 11*a* and 11*c* of the first banknote press member 11 located on the opposite sides and the number of the second banknote press members 15, 55, 56, 57 may be determined depending upon physical properties of the banknotes to be stacked.

Moreover, in the preferred embodiment shown in FIGS. 13 to 15, although the three second banknote press members 55, 56, 57 having the same length are employed, it is not absolutely necessary for the three second banknote press members 55, 56, 57 to have the same length and it is possible to employ second banknote press members having different lengths depending upon the banknotes to be stacked.

Further, in the preferred embodiment shown in FIGS. 13 to 15, each of the surfaces of the three second banknote press members 55, 56, 57 in the vicinity of the downstream end portions thereof is firmly fixed to one of the teeth 11*a*, 11*b*, 11*c* of the first banknote press member 11 and each of the second banknote press members 55, 56, 57 is formed with one of the creases 55*b*, 56*b*, 57*b* in contact with the portion where it is fixed to the first banknote press member 11. On the other hand, each of the surfaces of the second banknote press members 55, 57 disposed on the opposite sides in the vicinity of the upstream end portions thereof is firmly fixed to the mounting member 16 at a position upstream of the support shaft 10 and on the side toward the first banknote press member 11 from the support shaft 10 and each of the second banknote press members 55, 57 is formed with the crease 55*a* or 57*a* in contact with the portion where it is firmly fixed to the mounting member 16. To the contrary, the upstream end portion of the second banknote press member 56 disposed at the central portion is inserted into the slit 18 formed in the mounting member 16 at a position upstream of the support shaft 10 and on the side toward the first banknote press member 11 from the support shaft 10 and is firmly fixed to the inner surface of the slit 18. However, it is not absolutely necessary to mount the upstream end portions of the second banknote press members 55, 56, 57 on the body of the banknote stacking apparatus and mount the downstream end portions of the second banknote press members 55, 56, 57 on the first banknote press member 11 in this manner and it is possible to form a pair of slits 18 in the mounting member 16 at a position upstream of the support shaft 10 and on the side toward the first banknote press member 11 from the support shaft 10, insert the downstream end portions of the second banknote press members 55, 57 disposed on the opposite sides and firmly fix the downstream end portions of the second banknote press members 55, 57 to the inner surface of the pair of slits and on the other hand, it is possible to firmly fix the surface of the second banknote press member 56 disposed at the central portion in the vicinity of the upstream end portion thereof to the mounting member 16 at a position upstream of the support shaft 10 and on the side toward the first banknote press member 11 from the support shaft 10 and form a crease in the second banknote press member 56 in contact with a portion where the second banknote press member 56 is firmly fixed to the mounting member 16, for example. In this manner, it is possible to determine how to mount the upstream end portions and the downstream end portions of the second banknote press members 55, 56, 57 depending upon physical properties of the banknotes to be stacked.

Furthermore, in the above described preferred embodiments, the banknote stacking plate 1 includes the first horizontal surface portion 1*a* extending substantially horizontally from the portion in the vicinity of the vane wheel 3, the inclined surface portion 1*c* extending obliquely downward from the downstream end portion of the first horizontal surface portion 1*a* and the second horizontal surface portion 1*b* extending substantially horizontally from the downstream end portion of the inclined surface portion 1*c* and the banknote stacking apparatus is constituted so that the first banknote press member 11 presses a banknote toward the inclined surface portion 1*c* and the second banknote press members 15, 55, 56, 57 press a banknote toward the first horizontal surface portion 1*a*. However, it is not absolutely necessary to use a banknote stacking plate 1 having such a configuration and to constitute so that the first banknote press member 11 presses a banknote toward the inclined surface portion 1*c* of the banknote stacking plate 1 and the second banknote press members 15, 55, 56, 57 press a banknote toward the first horizontal surface portion 1*a* of the banknote stacking plate 1 and a banknote stacking plate 1 having another configuration such as a flat banknote stacking plate extending only in the horizontal direction can be used instead of the banknote stacking plate 1 including the first horizontal surface portion 1*a* extending substantially horizontally from the portion in the vicinity of the vane wheel 3, the inclined surface portion 1*c* extending obliquely downward from the downstream end portion of the first horizontal surface portion 1*a* and the second horizontal surface portion 1*b* extending substantially horizontally from the downstream end portion of the inclined surface portion 1*c*.

Moreover, in the preferred embodiment shown in FIGS. 1 to 5, the preferred embodiment shown in FIGS. 6 to 8, the preferred embodiment shown in FIGS. 9 and 10 and the preferred embodiment shown in FIGS. 11 and 12, although the portion of the banknote fed to above the banknote stacking plate 1 between the front end portion (downstream end portion) thereof and the portion thereof spaced apart from the front end portion by a distance equal to about one-fifth (1/5) of the length of the banknote is pressed by the first banknote press member 11 toward the inclined surface portion 1*c* of the banknote stacking plate 1, it is not absolutely necessary for the portion of the banknote between the front end portion (downstream end portion) thereof and the portion thereof spaced apart from the front end portion by a distance equal to about one-fifth (1/5) of the length of the banknote to be pressed by the first banknote press member 11 and it is possible to constitute the first banknote press member 11 so as to press a different portion of the banknote by changing the length of the first banknote press member 11, the position of the inclined surface portion 1*c* of the banknote stacking plate 1 to be pressed by the first banknote press member 11 and the like.

Further, in the preferred embodiment shown in FIGS. 1 to 5, the preferred embodiment shown in FIGS. 6 to 8, the preferred embodiment shown in FIGS. 9 and 10 and the preferred embodiment shown in FIGS. 11 and 12, the banknote stacking apparatus is constituted so that the portion of the banknote fed to above the banknote stacking plate 1 between substantially the central portion in the longitudinal direction thereof and the rear end portion (upstream end portion) thereof is pressed toward the banknote stacking plate 1 by the convex portion 15*c* of the second banknote press member 15 formed by the deformation of the second banknote press member 15. However, it is not absolutely necessary to constitute the banknote stacking apparatus so that the portion of the banknote between substantially the central portion in the longitudinal direction thereof and the rear end portion (upstream end portion) thereof is pressed toward the banknote stacking plate 1 by the convex portion 15*c* of the second banknote press member 15 formed by the deformation of the second banknote press member 15 and it is possible to constitute the banknote stacking apparatus so that the convex portion 15*c* of the second banknote press member 15 formed by the deformation of the second banknote press member 15 presses a different portion of the banknote by changing the length of the second banknote press member 15, the position of the first banknote press member 11 to which the second banknote press member 15 is fixed, how the second banknote press member 15 is fixed to the first banknote press member 11, the portion of the banknote stacking apparatus to which the second banknote press member 15 is fixed, how the second banknote press member 15 is fixed to the banknote stacking apparatus and the like.

Furthermore, in the case where the banknote handling machine is adapted for handling a banknote such as a foreign banknote whose size is larger than that of a banknote intended to be stacked in the preferred embodiment shown in FIGS. 1 to 5, the preferred embodiment shown in FIGS. 6 to 8, the preferred embodiment shown in FIGS. 9 and 10 or the preferred embodiment shown in FIGS. 11 and 12, the length of the first banknote press member 11, the position of the inclined surface portion 1*c* of the banknote stacking plate 1 to be pressed by the first banknote press member 11 and the like may be changed depending upon the size of a banknote to be stacked so that the portion of the banknote between the front end portion (downstream end portion) thereof and a portion spaced apart from the front end portion thereof by a distance equal to about one-fifth (⅕) of the length of the banknote can be pressed by first banknote press member 11, and the length of the second banknote press member 15, the portion of the first banknote press member 11 to which the second banknote press member 15 is fixed, how the second banknote press member 15 is fixed to the first banknote press member 11, the position of the banknote stacking apparatus to which the second banknote press member 15 is fixed, how the second banknote press member 15 is fixed to the banknote stacking apparatus, and the like may be changed depending upon the size of a banknote to be stacked so that the portion of the banknote between substantially the central portion thereof in the longitudinal direction and the rear end portion (upstream end portion) thereof can be pressed by the convex portion 15*c* of the second banknote press member 15 formed by the deformation of the second banknote press member 15.

Moreover, in the preferred embodiment shown in FIGS. 13 to 15, the banknote stacking apparatus is constituted so that the portion of the banknote fed to above the banknote stacking plate 1 between substantially the center portion of the banknote in the longitudinal direction thereof and the rear end portion (upstream portion) of the banknote and relatively closer to the center portion can be pressed by the second banknote press members 55, 57 disposed on the opposite sides and the portion of the banknote fed to above the banknote stacking plate 1 between substantially the center portion of the banknote in the longitudinal direction thereof and the rear end portion thereof and relatively closer to the rear end portion (upstream end portion) is pressed by the second banknote press member 56 disposed at a central portion. However, an arbitrarily portion of the banknote may be pressed by the second banknote press members 55, 56, 57 by changing the lengths of the second banknote press members 55, 56, 57, the portions of the first banknote press member 11 to which the second banknote press members 55, 57 are fixed, how the second banknote press members 55, 57 is fixed to the first banknote press member 11, the portions of the banknote stacking apparatus to which the second banknote press members 55, 57 are fixed, how the second banknote press members 55, 57 is fixed to the banknote stacking apparatus, the portion of the first banknote press member 11 to which the second banknote press member 56 is fixed, how the second banknote press member 56 is fixed to the first banknote press member 11, the portion of the banknote stacking apparatus to which the second banknote press member 56 is fixed, how the second banknote press member 56 is fixed to the banknote stacking apparatus or the like.

Further, in the case where the banknote handling machine is adapted for handling a banknote such as a foreign banknote whose size is larger than that of a banknote intended to be stacked in the preferred embodiment shown in FIGS. 13 to 15, the lengths of the second banknote press members 55, 56, 57, the portions of the first banknote press member 11 to which the second banknote press members 55, 57 are fixed, how the second banknote press members 55, 57 is fixed to the first banknote press member 11, the portions of the banknote stacking apparatus to which the second banknote press members 55, 57 are fixed, how the second banknote press members 55, 57 is fixed to the banknote stacking apparatus, the portion of the first banknote press member 11 to which the second banknote press member 56 is fixed, how the second banknote press member 56 is fixed to the first banknote press member 11, the portion of the banknote stacking apparatus to which the second banknote press member 56 is fixed, how the second banknote press member 56 is fixed to the banknote stacking apparatus and the like may be changed depending upon the size of a banknote to be handled so that the portion of the banknote fed to above the banknote stacking plate 1 between substantially the center portion of the banknote in the longitudinal direction thereof and the rear end portion (upstream portion) of the banknote and relatively closer to the center portion positioned can be pressed by the second banknote press members 55, 57 and the portion of the banknote fed to above the banknote stacking plate 1 relatively closer to the rear end portion (upstream end portion) between substantially the center portion of the banknote in the longitudinal direction thereof and the rear end portion thereof can be pressed by the second banknote press member 56.

According to the present invention, it is possible to provide an apparatus for stacking sheets in the desired manner by means of a simple structure even in the case where a sheet is folded at substantially a central portion thereof, where a sheet is curled at the front end portion thereof, where a sheet can be easily folded or where a sheet is wrinkled.

The various embodiments described above can be combined to provide further embodiments. All of the U.S. patents, U.S. patent application publications, U.S. patent application, foreign patents, foreign patent application and non-patent publications referred to in this specification and/or listed in the Application Data Sheet are incorporated herein by reference, in their entirety. Aspects of the embodiments can be modified, if necessary to employ concepts of the various patents, application and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A sheet stacking apparatus comprising a sheet stacking plate on the surface of which sheets are to be stacked, a first sheet press member whose upstream end portion with respect to a transporting direction of the sheets is firmly fixed to a support shaft so as to be swingable as the support shaft is rotated, a biasing means for biasing the first sheet press member so as to come off from the sheet stacking plate and holding the first sheet press member at a waiting position thereof, a single sheet press member driving means for driving the first sheet press member against a biasing force of the biasing means and pressing the downstream end portion of the first sheet press member toward the sheet stacking plate, at least one second sheet press member whose upstream end portion is mounted on a body of the sheet stacking apparatus and whose downstream end portion is mounted on the first sheet press member, a sensor means for detecting the rear end portion of a sheet to be stacked on the sheet stacking plate, and a control means for actuating the single sheet press member driving means based on a sheet detection signal output from the sensor means when a predetermined time period has passed after the sensor means detected the sheet, the at least one second sheet press member being made of a flexible material, the sheet stacking apparatus being constituted so that the upstream end portion of the at least one second sheet press member is mounted on the body of the sheet stacking apparatus and the downstream end portion of the at least one second sheet press member is mounted on the first sheet press member in such a manner that when the single sheet press member driving means drives the first sheet press member to press the downstream end portion of the first sheet press member against the biasing force of the biasing means toward the sheet stacking plate, the distance between the upstream end portion of the at least one second sheet press member and the downstream end portion thereof is shortened.

2. A sheet stacking apparatus in accordance with claim 1, wherein the upstream end portion of the at least one second sheet press member is mounted on a portion of the body of the sheet stacking apparatus on the upstream side of the support shaft.

3. A sheet stacking apparatus in accordance with claim 2, wherein the upstream end portion of the at least one second sheet press member is mounted on the body of the sheet stacking apparatus at a position on the side toward the sheet stacking plate from a plane including a main portion of the first sheet press member located at the waiting position thereof and the support shaft.

4. A sheet stacking apparatus in accordance with claim 1, wherein the upstream end portion of the at least one second sheet press member is mounted on the body of the sheet stacking apparatus at a position on the side toward the sheet stacking plate from a plane including the support shaft and parallel with a plane including a main portion of the first sheet press member located at the waiting position thereof.

5. A sheet stacking apparatus in accordance with claim 2, wherein the upstream end portion of the at least one second sheet press member is mounted on the body of the sheet stacking apparatus at a position on the side toward the sheet stacking plate from a plane including the support shaft and parallel with a plane including a main portion of the first sheet press member located at the waiting position thereof.

6. A sheet stacking apparatus in accordance with claim 5, wherein a surface of at least one second sheet press member in the vicinity of the upstream end portion thereof is firmly fixed to the body of the sheet stacking apparatus.

7. A sheet stacking apparatus in accordance with claim 5, wherein the upstream end portion of the at least one second sheet press member is mounted on the body of the sheet stacking apparatus so as to be swingable about a support shaft provided in the body of the sheet stacking apparatus.

8. A sheet stacking apparatus in accordance with claim 5, wherein a surface of the at least one second sheet press member in the vicinity of the downstream end portion thereof is firmly fixed to the first sheet press member.

9. A sheet stacking apparatus in accordance with claim 5, wherein the downstream end portion of the at least one second sheet press member is mounted on the first sheet press member so as to be swingable about a support shaft provided in the first sheet press member.

10. A sheet stacking apparatus in accordance with claim 5, wherein the first sheet press member has a fork-like shape and has a plurality of teeth formed by furcating a downstream portion of the first sheet press member, and the downstream end portion of the at least one second sheet press member is connected with at least one of the plurality of teeth of the first sheet press member.

11. A sheet stacking apparatus in accordance with claim 10, which further comprises a plurality of the second sheet press members and the downstream portion of each of the plurality of the second sheet press members is connected with one of the plurality of teeth of the first sheet press member.

12. A sheet stacking apparatus in accordance with claim 11, wherein the upstream portion of at least one of the plurality of second sheet press members is connected with the body of the sheet stacking apparatus in a different manner from a manner of connecting the other upstream portions of the plurality of second sheet press members with the body of the sheet stacking apparatus.

13. A sheet stacking apparatus in accordance with claim 11, wherein the downstream portion of at least one of the plurality of second sheet press members is connected with the plurality of teeth of the first sheet press member in a different manner from a manner of connecting the other downstream portions of the plurality of second sheet press members with the plurality of teeth of the first sheet press member.

14. A sheet stacking apparatus in accordance with claim 5, wherein the second sheet press member is formed of a sheet selected from a group consisting of a synthetic resin sheet and a metal sheet.

15. A sheet stacking apparatus in accordance with claim 5, which further comprises a vane wheel for scraping off rear end portions of sheets toward the upper surface of the sheet stacking plate.

16. A sheet stacking apparatus in accordance with claim 1, wherein a surface of at least one second sheet press member in the vicinity of the upstream end portion thereof is firmly fixed to the body of the sheet stacking apparatus.

17. A sheet stacking apparatus in accordance with claim 1, wherein the upstream end portion of the at least one second sheet press member is firmly fixed to a linear region of the body of the sheet stacking apparatus, whereby the upstream end portion of the at least one second sheet press member is mounted on the body of the sheet stacking apparatus.

18. A sheet stacking apparatus in accordance with claim 17, wherein the upstream end portion of the at least one second sheet press member is firmly fixed to an inner surface of a slit formed in the body of the sheet stacking apparatus, whereby the upstream end portion of the at least one second sheet press member is mounted on the body of the sheet stacking apparatus.

19. A sheet stacking apparatus in accordance with claim 1, wherein the upstream end portion of the at least one second sheet press member is mounted on the body of the sheet stacking apparatus so as to be swingable about a support shaft provided in the body of the sheet stacking apparatus.

20. A sheet stacking apparatus in accordance with claim 1, wherein a surface of the at least one second sheet press member in the vicinity of the downstream end portion thereof is firmly fixed to the first sheet press member.

21. A sheet stacking apparatus in accordance with claim 1, wherein the downstream end portion of the at least one second sheet press member is firmly fixed to a linear region of the first sheet press member.

22. A sheet stacking apparatus in accordance with claim 1, wherein the downstream end portion of the at least one second sheet press member is mounted on the first sheet press member so as to be swingable about a support shaft provided in the first sheet press member.

23. A sheet stacking apparatus in accordance with claim 1, wherein the first sheet press member has a fork-like shape and has a plurality of teeth formed by furcating a downstream portion of the first sheet press member, and the downstream end portion of the at least one second sheet press member is connected with at least one of the plurality of teeth of the first sheet press member.

24. A sheet stacking apparatus in accordance with claim 23, which further comprises a plurality of the second sheet press members and the downstream portion of each of the plurality of the second sheet press members is connected with one of the plurality of teeth of the first sheet press member.

25. A sheet stacking apparatus in accordance with claim 24, wherein the upstream portion of at least one of the plurality of second sheet press members is connected with the body of the sheet stacking apparatus in a different manner from a manner of connecting the other upstream portions of the plurality of second sheet press members with the body of the sheet stacking apparatus.

26. A sheet stacking apparatus in accordance with claim 24, wherein the downstream portion of at least one of the plurality of second sheet press members is connected with the plurality of teeth of the first sheet press member in a different manner from a manner of connecting the other downstream portions of the plurality of second sheet press members with the plurality of teeth of the first sheet press member.

27. A sheet stacking apparatus in accordance with claim 1, wherein the second sheet press member is formed of a sheet selected from a group consisting of a synthetic resin sheet and a metal sheet.

28. A sheet stacking apparatus in accordance with claim 1, which further comprises a vane wheel for scraping off rear end portions of sheets toward the upper surface of the sheet stacking plate.

* * * * *